United States Patent [19]

Perkins et al.

[11] 4,403,124

[45] Sep. 6, 1983

[54] VACUUM CIRCUIT INTERRUPTER WITH INSULATED VACUUM MONITOR RESISTOR

[75] Inventors: John F. Perkins, Churchill Borough; Norman Davies, Levelgreen, both of Pa.

[73] Assignee: Westinghouse Electric Corp., Pittsburgh, Pa.

[21] Appl. No.: 226,332

[22] Filed: Jan. 19, 1981

[51] Int. Cl.[3] ..... H01H 33/00

[52] U.S. Cl. ..... 200/144 B; 200/50 AA

[58] Field of Search ..... 200/144 B, 154; 324/457, 463

[56] References Cited

U.S. PATENT DOCUMENTS 3,575,656 4/1971 Watrous, Jr. ..... 324/463

4,103,291 7/1978 Howe ..... 200/144 B

*Primary Examiner*—A. T. Grimley

*Assistant Examiner*—Morris Ginsburg

*Attorney, Agent, or Firm*—M. J. Moran

[57] ABSTRACT

A vacuum circuit interrupter as taught which utilizes the vapor deposition shields thereof in the existing high voltage source or network which is controlled by the circuit interrupter to produce a cold cathode ion detector for determining the quality or amount of vacuum within the vacuum circuit interrupter. The central shield support ring which protrudes through the insulating casing of the circuit interrupter is used to supply ion current to a current detecting bridge through a circumferentially insulated surge resistor and from there to the common terminal of the aforementioned voltage source to thereby return one of the plates of the ion detecting device to the voltage source.

16 Claims, 14 Drawing Figures

VACUUM CIRCUIT INTERRUPTER WITH INSULATED VACUUM MONITOR RESISTOR

CROSS-REFERENCE TO RELATED APPLICATION

The subject matter of this invention is related to concurrently filed and copending patent application Ser. No. 226,331, filed Jan. 19, 1981 entitled "Vacuum Circuit Interrupter With On-Line Vacuum Monitoring Apparatus".

BACKGROUND OF THE INVENTION

The subject matter of this invention relates generally to vacuum circuit interrupters and more particularly to vacuum circuit interrupters having high voltage vacuum monitoring devices which utilize internal shields as part of a cold cathode magnetron signal producing ionization device and which supply the signal through an insulated surge resistor to a low voltage measuring circuit.

Vacuum type circuit interrupters are well known. Generally a vacuum circuit interrupter is formed by disposing a pair of separable main contacts within a hollow insulating casing, one of the contacts is usually fixed to an electrically conductive plate disposed at one end of the hollow casing. The other contact is movably disposed relative to another conductive plate at the other end of the insulating casing. Since a vacuum interrupter requires that the contact region be evacuated, the movable contact is interconnected mechanically with its end plate by way of a flexible bellows arrangement. Typically, the internal portion of the casing is evacuated to a pressure of $10^{-4}$ Torr or less. Because the electric arc of interruption takes place in a vacuum, the arc has a tendency to diffuse and the dielectric strength per unit distance of separation tends to be relatively high when compared with other types of circuit interrupting apparatus. The vacuum circuit interrupter then has a number of significant advantages one of which is relatively high speed current interruption and another of which is short travel distance for the separating contacts. Since metal vapor is often produced during the interruption process, metal vapor shields are often disposed coaxially within the insulated casing to prevent the vaporous products from impinging upon the inner walls of the casing where the vapor products can condense and render the insulating casing conducting or they could attack the vacuum seal between the electrically conducting end plates and the cylindrical insulating casing. Vacuum type circuit interrupters are shown and described in U.S. Pat. No. 2,892,912 entitled "Vacuum Type Circuit Interrupter" by A. Greenwood et al., U.S. Pat. No. 3,163,734 entitled "Vacuum-Type Circuit Interrupter With Improved Vapor Condensing Shielding" by T. H. Lee, U.S. Pat. No. 4,224,550 entitled "Vacuum Discharge Device With Rod Electrode Array" by J. A. Rich and U.S. Pat. No. 4,002,867 entitled "Vacuum-Type Circuit Interrupters With Condensing Shield At A Fixed Potential Relative To The Contacts" by S. J. Cherry. The latter patent is assigned to the assignee of the present invention. As one might expect the successful operation of the vacuum circuit interrupter requires the presence of a vacuum in the region of interruption. However, if the vacuum interrupter develops a leak so that the gas pressure within the vacuum interrupter rises to a level above $10^{-3}$ Torr, for example, the safe operation of the vacuum circuit interrupter may be seriously hindered if not rendered impossible. Consequently, it has always been a desire to reliably determine whether a vacuum is in fact present in the arc interrupting region. Voltage breakdown apparatus, for example, has been utilized in the past to determine this as is described in U.S. Pat. No. 3,983,345 entitled "Method Of Detecting A Leak In Any One Of The Vacuum Circuit Interrupters Of A High Voltage Circuit Breaker" by V. E. Phillips. On the other hand, an oil level measuring system is described in U.S. Pat. No. 3,626,125 by A. Tonegawa may be used. These methods generally are relatively expensive, space consuming and complicated. It was found that the principle of the cold cathode ionization gauge could be utilized relatively simply and inexpensively to detect the presence of a vacuum. Such devices are described in U.S. Pat. No. 4,000,457 entitled "Cold Cathode Ionization Gauge Control For Vacuum Measurement" by C. D. O'Neal III, U.S. Pat. No. 3,582,710 entitled "Ultrahigh Vacuum Magnetron Ionization Gauge With Ferromagnetic Electrodes" by L. J. Favreau and U.S. Pat. No. 3,581,195 entitled "Detection Of Vacuum Leaks By Gas Ionization Method And Apparatus Providing Decreased Vacuum Recovery Time" by R. L. Jepsen. A d.c. cold cathode ionization gauge is relatively well known. Simply, it relies upon the spontaneous release of electrons from a "cold cathode" and their subsequent motion under the influence of electric and magnetic fields. The magnetic field has the effect of maintaining the electrons in the region between electrodes for a relatively long period of time. It has been found that a self limiting value of $10^{+10}$ electrons per cubic centimeter plus or minus an order of magnitude or so is usually the density of the electron cloud produced in a typical ion gauge. If a gas is present in the region, the electrons will strike some of the gas molecules, thus causing other electrons to be given off, therefore sustaining the electron cloud. Furthermore, the gas molecules acquire electric charge when impacted by an electron. The charged molecules migrate according to the polarity of the electrostatic field towards one of the electrodes whereupon they each receive an electron from the electrode. As the electrons of the electrode combine with the gas ions at the surface of the electrode to neutralize the ions, an electrical current is sustained in an electrical circuit which includes the electrodes. If an ammeter is inserted in series circuit relationship in the aforementioned circuit and calibrated appropriately, an electrical indication of the density of gas present between the electrodes is attainable. This principle has been applied to DC vacuum circuit interrupters. For example, U.S. Pat. No. 3,263,162 entitled "Apparatus And Method For Measuring The Pressure Inside A Vacuum Circuit Interrupter" by J. R. Lucek, et al., and U.S. Pat. No. 3,403,297 entitled "Vacuum-Type Circuit Interrupter With Pressure-Monitoring Means" by D. W. Crouch, teach the utilization of a single vapor deposition shield within a vacuum circuit interrupter utilized in conjunction with one of the main electrodes to form a cold cathode magnetron device. This is made possible by the fact that most of the vapor shields have an intermediate ring which protrudes outwardly through the insulated casing, generally at the axial midpoint of the latter mentioned casing. One disadvantage associated with this type of arrangement lies in the fact that the electron cloud is formed near the main electrode thus increasing the opportunity for voltage breakdown between electrodes or electrodes and shield. Another disadvantage lies in the fact that the placement of the magnet around the insulating casing often provides insufficient flux density. Also the formation of the electron cloud near the main contacts often jeopardizes the interrupting function. Another cold cathode measuring device is taught in U.S. Pat. No. 4,163,130 entitled "Vacuum Interrupter With Pressure Monitoring Means" by Kubota et al. in which a separate vacuum gauge is attached to an opening in one portion of an end plate of an AC vacuum interrupter. This device does not require the presence of the shields or the utilization of the main electrodes directly. However, it creates a disadvantage in that the vacuum integrity of the system may be affected by the mere inclusion of the detection gauge therein. Furthermore because of the geometry of the gauge the pressure inside the device may be slightly different from that in the vacuum chamber even though it communicates therewith. None of the three latter patents teach the use of multiple vapor deposition, i.e. end shields and an intermediate shield, within the circuit interrupter vacuum bottle. It has been shown to be advantageous to use multiple shields within the circuit interrupter as is described for example in U.S. Pat. No. 3,575,656 entitled "Method And Apparatus For Measuring Pressure In Vacuum Interrupters" by W. W. Waltrous, Jr. The end shields are spaced from the central or intermediate shield to maintain high voltage isolation therebetween. The end shields provide the additional function of more directly protecting the sensitive end plate-to-insulating cylinder seal where there is great opportunity for metal vapors to effect vacuum integrity by destroying the seals. However, in the latter patent the central shield is not available for external circuit connection as it does not protrude through the insulating casing of the circuit interrupter. In the aforementioned copending application Ser. No. 226,331 a relatively reliable cold cathode magnetron vacuum detecting device is utilized which is relatively unaffected by the opening and closing of the main contacts, which does not require the addition of further leak regions than are already present in the vacuum circuit interrupter and which uses existing vacuum interrupter geometry for reduced cost. The detection of vacuum takes place at relatively high voltage in the latter case. It would be advantageous however, if the information thus gathered at high voltage potential could be utilized at low voltage potential.

SUMMARY OF THE INVENTION

In accordance with the invention a vacuum circuit interrupter is taught which includes a circuit interrupter frame upon which is disposed an enclosure means which defines a substantially evacuated volume. An external voltage source is provided for interconnection with relatively movable contacts within the evacuated volume. First and second spaced electrically conductive vapor deposition shields are disposed within the enclosure means for protecting internal portions of the enclosure means from the metal vapor products associated with the interruption of electrical current within the evacuated volume. The first and second spaced electrically conductive vapor deposition shields form therebetween an annular sub-volume. The first of the shields is interconnected electrically with one potential of the external voltage source, and the second shield is interconnected electrically within an electrical conductor on the outer portion of the enclosure. An encapsulated resistor is insulatingly disposed upon the frame. The resistor has a contact portion which makes electrical contact with the electrical conductor on the outer portion of the enclosure. A current measurement device is disposed outside of the enclosure in circuit relationship with the other end of the resistor and with another potential of the voltage source so that an electrical field of sufficient magnitude is present in the annular sub-volume to cause electron emission from one of the first or second shields. The emitted electrons interact with gas molecules in the sub-volume to form gas ions which in turn interact with one or both of the shields to cause ionic electrical current to flow through the encapsulated resistor and the external current measurement device to thus give an indication of the amount of gas present in the substantially evacuated volume.

BRIEF DESCRIPTION OF THE DRAWINGS

For a better understanding of the invention, reference may be had to the preferred embodiments thereof shown in the accompanying drawings in which.

DESCRIPTION OF THE PREFERRED EMBODIMENTS

Figure 1:
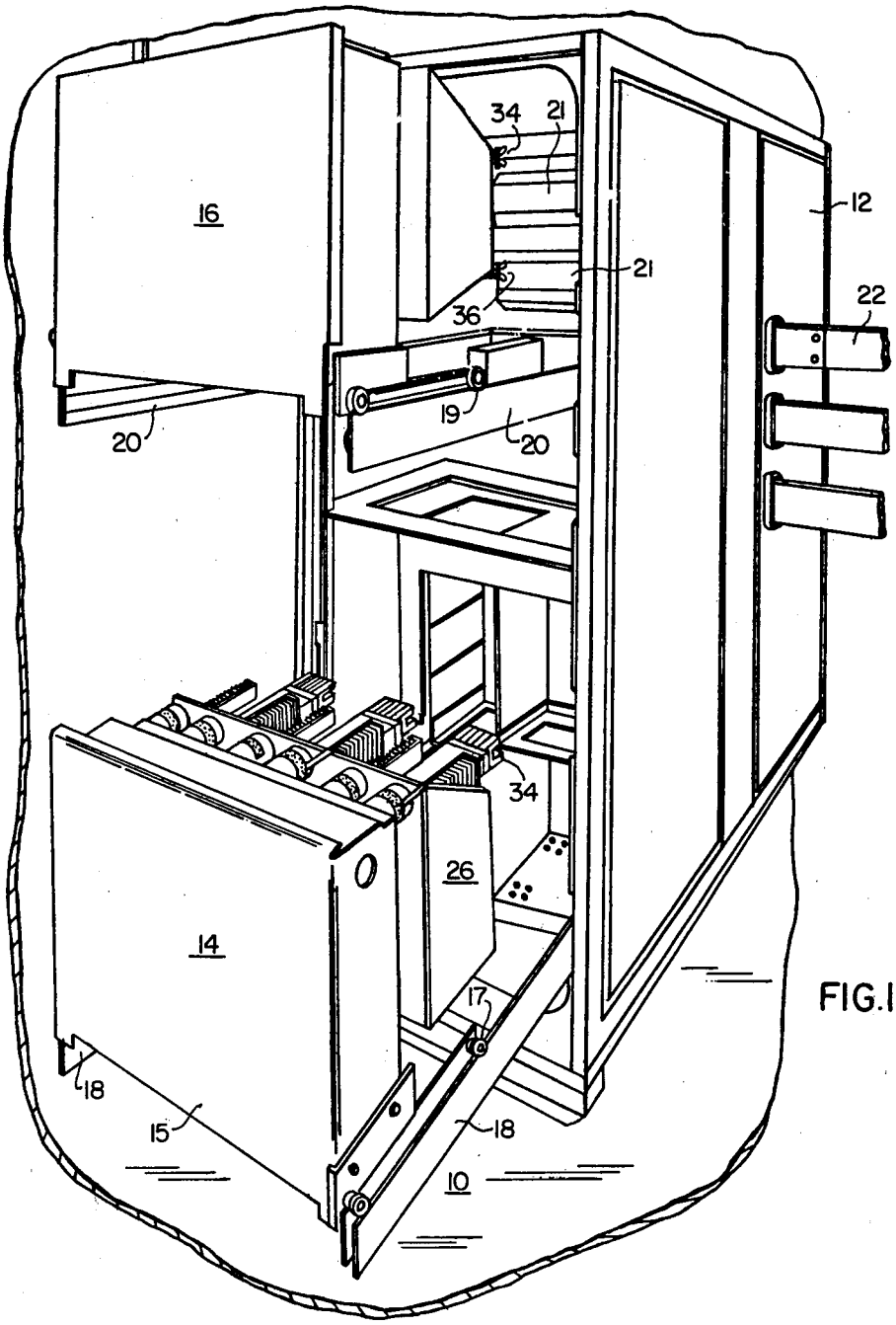
FIG. 1 shows an orthogonal front and side view of a metal enclosed circuit breaker system utilizing vacuum circuit interrupters and employing the teachings of the present invention.
Figure 2:
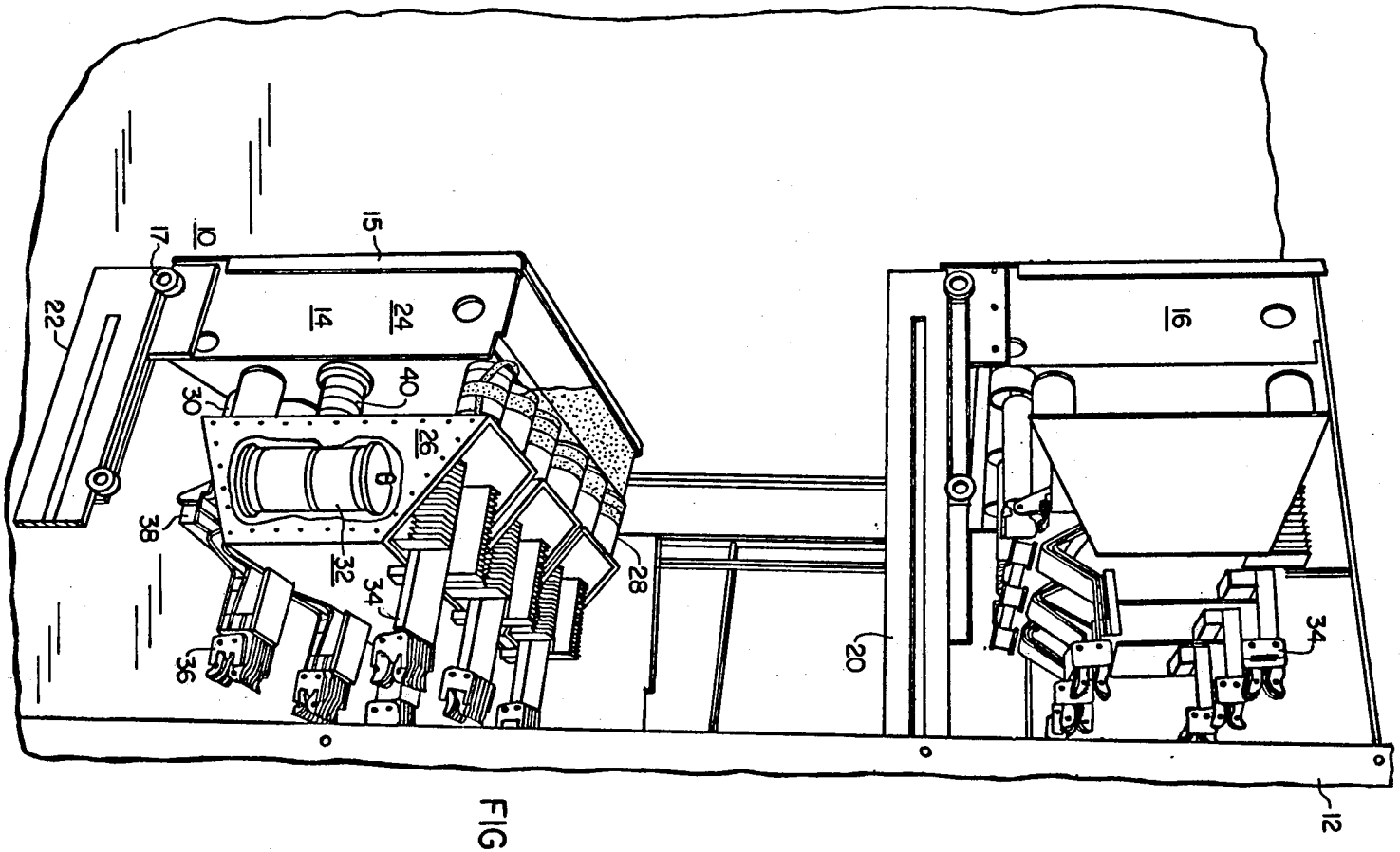
FIG. 2 shows a side orthogonal view of the apparatus of FIG. 1.

Referring now to the drawings, and FIGS. 1 and 2 in particular, there is shown an embodiment of the invention for metal clad or metal enclosed switchgear. In particular there is a switchgear station 10 which includes a metal cabinet or enclosure 12 having tandemly, vertically disposed therein drawout three-phase vacuum circuit interrupter apparatus 14 and 16. The front panel 15 of the circuit interrupter apparatus may have controls thereon for manually operating the circuit interrupter apparatus. The lower circuit interrupter apparatus 14 as shown in FIGS. 1 and 2, is movably disposed by way of wheels 17 on rails 18 for moving the circuit breaker apparatus 14 into and out of a disposition of electrical contact with live high voltage terminals (not shown) disposed in the rear of the cabinet 12. Likewise the upper circuit interrupter apparatus 16 is movably disposed by way of wheels 19 on rails 20 for moving the upper circuit interrupter apparatus into and out of a disposition of electrical contact with terminals (not shown) in the rear of metal cabinet 12. Movable shutters such as shown at 21 are interposed to cover the high voltage terminals in the rear of the cabinet when the breakers 14 and 16 are drawn out for shielding those high voltage terminals from inadvertent contact therewith. Barriers 21 are mechanically moved from in front of the aforementioned terminals when the three-phase circuit interrupters 14 and 16 are moved into a disposition of electrical contact with the aforementioned high voltage terminals.

As is best shown in FIG. 2, three-phase circuit interrupter apparatus 14 may include a front portion 24 in which controls and portions of an operating mechanism are disposed and a rear portion 26. The front portion 24 is generally a low voltage portion and the rear portion 26 is generally a high voltage portion. The high voltage portion 26 is supported by and electrically insulated from the low voltage portion 24 by way of upper and lower insulators 28 and 30, respectively. Disposed within the high voltage portion 26 are vacuum circuit interrupter bottles 32 which provide the circuit interrupting capability between the three-phase terminals 34 and 36, for example. The motion and much of the information for opening and closing the contacts of the vacuum circuit interrupter bottles 32 may be supplied by way of linkages 38 from the front portion 24 of the circuit interrupter apparatus 14.

Figure 3:
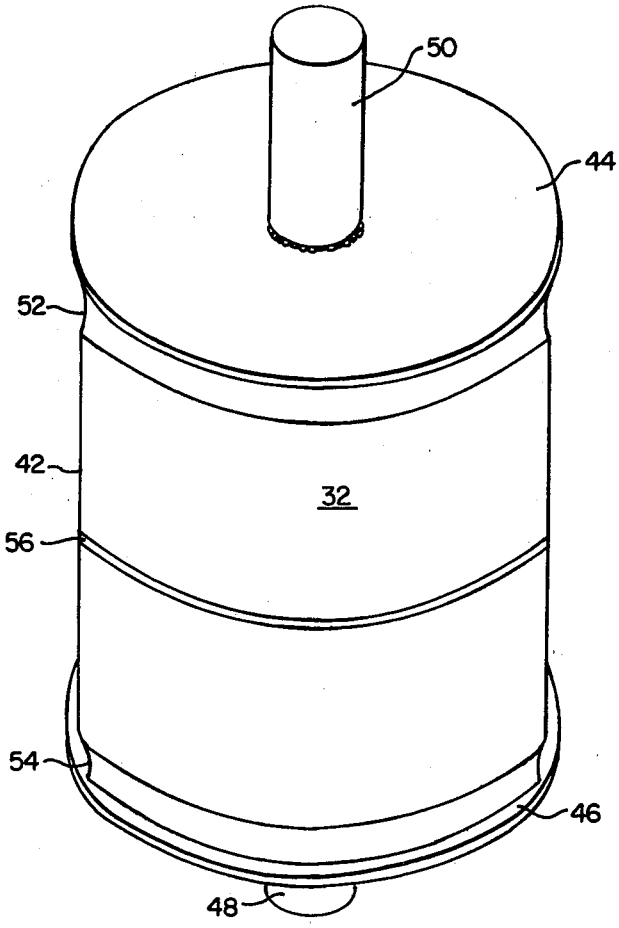
FIG. 3 shows an orthogonal view of a vacuum circuit interrupter bottle.

Referring now to FIG. 3, a three-dimensional view of a typical circuit interrupter bottle 32 which may be utilized in the high voltage section 26 of the apparatus of FIGS. 1 and 2, is shown. In particular, circuit interrupter bottle 32 may comprise an insulating cylinder 42 capped at either end by electrically conducting circular end caps 44 and 46. On the bottom is shown a vertically movable contact stem 48 and on the top is shown a fixed contact stem 50 which may be brazed, for example, to the aforementioned end plate 44. The end caps 44 and 46 are sealingly disposed on the ends of the cylinder 42 at seal regions 52 and 54, respectively as are shown in more detail in FIG. 4, for example. Longitudinally centrally disposed in the cylinder 42 may be an electrically conducting ring 56, the usefulness of which will be described in more detail hereinafter.

Referring once again to FIG. 2, in the preferred embodiment of the invention, the cylinder 32 is mounted within the high voltage portion or casing 26 of FIG. 2 so that the stationary stem 50 is placed in a disposition of electrical contact with the contact member 34. Likewise, the vertically movable stem 48 is disposed in a disposition of electrical contact with the terminal member 36. The operating mechanism 38 of FIG. 2 operates to force the vertically movable stem upward and downward when circuit interconnection or disconnection is sought, respectively, between the terminals 34 and 36.

It is to be understood with respect to the embodiment of the invention shown in FIGS. 1, 2 and 3 that three circuit interrupter bottles 32 each are disposed in the lower circuit interrupter apparatus 14 and in the upper circuit interrupter apparatus 16 to provide two sets of three-phase circuit interruption for two different electrical systems or networks if desired.

Figure 4:
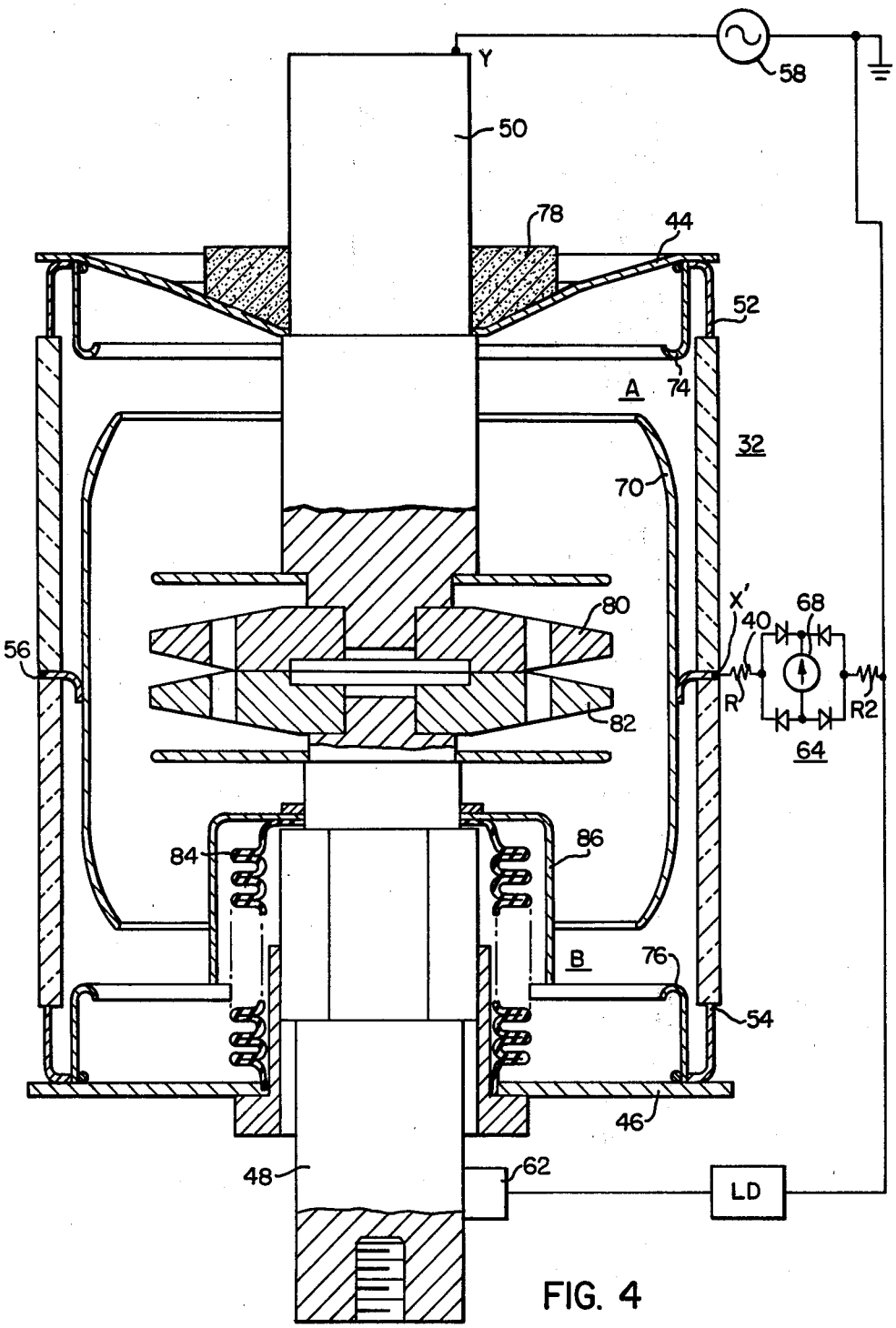
FIG. 4 shows a sectional view of the apparatus of FIG. 3 in which a magnet is utilized and with which a circuit schematic utilizing the concepts of the present invention is also shown.

Referring now to FIG. 4, a sectional view of the vacuum interrupter shown in FIGS. 2 and 3 is depicted with a schematic electrical circuit connected thereto. Electrically conducting end plates 44 and 46 are interconnected with the insulating barrel 42 at regions 52 and 54, respectively. An appropriate cementing or sealing process is utilized to make the seal vacuum reliable. It is known in the vacuum circuit interrupter art that these seals are sensitive regions which if attacked chemically, thermally or otherwise may break down thus destroying the vacuum integrity of the vacuum interrupter unit 32. Consequently, shields 70, 74 and 76 are provided for preventing vapor deposition against the inside wall of the insulator 42 and for preventing vapor products and the heat therefrom from degrading the seal in the regions 52 and 54. Shield 74 is suspended within the vacuum interrupter unit 32 from the end plate 44 while shield 76 is suspended or supported by the end plate 46. Typically, the centrally located shield 70 is brazed or otherwise interconnected with an annular ring 56 which is sandwiched between two portions of the porcelain insulator 42 for support thereby. Consequently, shield 70 is centrally supported away from the region of electrical interruption of the circuit interrupter 32. In this embodiment of the invention, external voltage source 58 which may be the voltage of a network, is interconnected with stem 50 at region y, for example. For purposes which will become apparent hereinafter, a resistive element R designated 40 for correspondence with what is shown in FIG. 2, is interconnected directly, capacitively or inductively, between the annular ring 56 and a current detection network 64 which may comprise a full wave bridge rectifier having a microammeter 68 disposed to measure the current flowing through the bridge. The other side of the bridge or detector circuit 64 is interconnected with the ground or return of the voltage source 58 and with one side of a load LD. The other side of the load LD is interconnected with a commutating device 62 for interconnection with the movable stem 48. Connected internally of the circuit interrupter 32 with the stems 50 and 48, respectively, are vacuum circuit interrupter contacts 80 and 82. There may also be provided an internal shield 86 for a bellows 84. The bellows 84 is expandable with and contractable with the movement of the stem 48 to maintain vacuum integrity. Consequently, the internal portion of the circuit interrupter 32 is normally vacuum tight. The vacuum represents a desirable region in which to interrupt current flowing between contacts 80 and 82 as stem 48 moves downwardly (with respect to FIG. 4) to cause a separation or gap to exist between contacts 80 and 82. The introduction of the vacuum gap between the contacts 80 and 82 causes a diffused arc to exist between the contacts 80 and 82 during the current interrupter process which extinguishes usually on the next current zero of the current. Because of the insulating properties of a vacuum, the travel of the stem 48 in a downward direction can be relatively small while nevertheless retaining high voltage insulating capability between the open contacts 80 and 82. The shields 76, 74 and 70 have rounded or curvilinear end regions thereon to prevent high voltage breakdown therebetween when the contacts 80 and 82 are opened. The depression in the end piece 44 is to provide a positive bias against the operation of the stem 48 in the upward direction. The force provided against stem 48 tends to be relatively high and therefore the bias of the end plate 44 helps to prevent significant movement of the contact 80 in response thereto. A magnet 78 is shown disposed axially around the stem 50 in the depression of the end plate 44. Preferably, this is a permanent magnet, but may in another embodiment of the invention be an electromagnet, and in another embodiment may be a magnet not disposed axially (refer to FIG. 12) and may even be missing from still other embodiments of the invention. The purpose of this magnet will be described hereinafter with respect to other figures.

It will be noted that when the contacts 80 and 82 are closed, the high voltage source 58 provides current through stem 50, contact 80, contact 82, stem 48, commutating device 62, and the load LD. Of course, when the contacts 80 and 82 are opened, the load LD is isolated from the high voltage source 58 and no current flows therethrough. It will be noted that the detecting device 64 described previously is on the low voltage side of the resistive element R. The other side of the resistive element R may be of relatively high potential because of the proximity of the shields 70, 76 and 74 to the contacts 80 and 82. It will be noted that the shield 74, for example, on an appropriate half cycle of the voltage source 58 may be at a relatively high voltage. Furthermore, a capacitive electrostatic field may exist between the shield 74 and the shield 70 due to the interconnection of the shield 70 through the resistive elements 40, and the bridge circuit 64, to the other side of the voltage source 58. It will be noted that the shield 70, when cooperating with the shield 74 or the shield 76, forms an annular region spaced away from the contacts 80 and 82 relative to the available amount of radial distance within the vacuum circuit interrupter 32. Within either or both of these annular spaces, a pressure detection ion gauge may may be utilized in conjunction with the resistive element R and the bridge circuit 64 to determine the amount of vacuum or quality of vacuum within the circuit interrupter 32. The ion gauge is such that under appropriate conditions of electrostatic field strength (and in some instances transverse magnetic field strength, such as may be provided by the magnet 78) cold cathode emitted electrons from any of the shields 74, 70 or 76 may interact with gas molecules thus forming ions which impinge any of the shields 70, 74 and 76 to set up current which can be measured by the microammeter 68 to give an indication of the amount of gas within the vacuum circuit interrupter 32. Consequently, this gives an indication of the quality of vacuum within the circuit interrupter 32. The magnet 78 operates to cause the electrons to remain in the annular region for a relatively long period of time thus enhancing the opportunity for them to strike even relatively small amounts of gas molecules to set up the aforementioned current. In other instances, the effect of the magnet is not necessary and the magnet may be deleted as it has been found that at certain higher pressures desirable information about the quality of the vacuum within the vacuum interrupter 32 may be obtained because of current flow due to a "glow-discharge" between the shields. The current, for example, may flow from the voltage source 58, through the stem 50, through the electrically connected end plate 44, through the upper shield 74, via the cold cathode discharge a "glow discharge" to the lower shield 70, the annular ring 56, through the resistor R, the bridge 64, and finally to the other side of the voltage source 58. An exemplary plot of current versus pressure is shown, for example, in FIG. 6 which will be described hereinafter.

Figure 14:
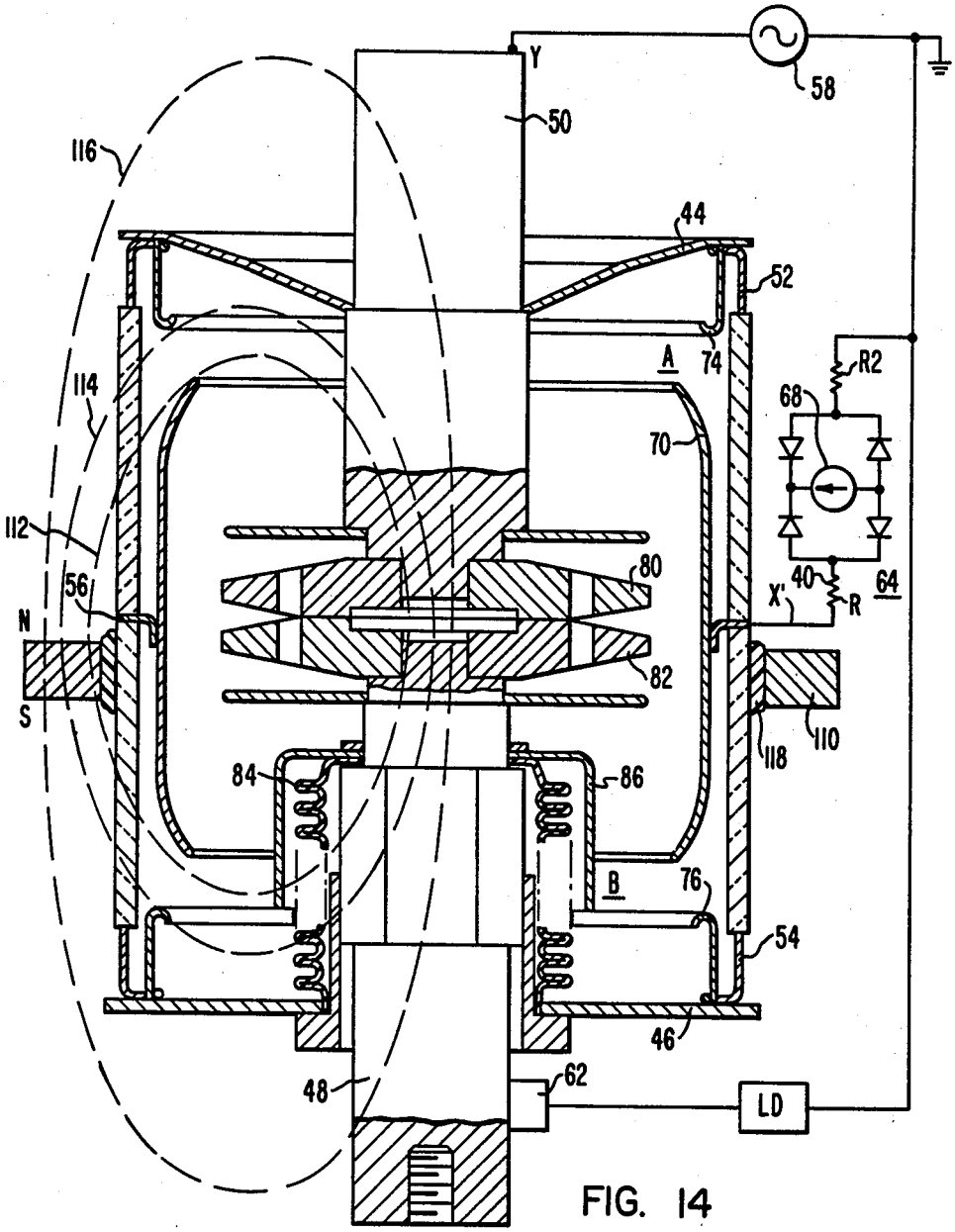
FIG. 14 shows an embodiment similar to that shown in FIG. 4 in which a "hoop" magnet is utilized.

FIG. 14 shows an embodiment of the invention in which a "hoop" type magnet 110 is utilized instead of the "pancake" type magnet 78. In the embodiment of the invention shown in FIG. 14, the north pole is shown at the top of the magnet 110 relative to FIG. 14, and the south pole is shown at the bottom. Representative magnetic flux lines 112, 114, 116 are shown. For purposes of simplicity of illustration, only the magnetic flux lines on the left of FIG. 14 are shown, it being understood that the magnetic flux lines on the right are generally mirror images of the magnetic lines on the left. Furthermore, magnetic flux lines 112, 114 are shown permeating regions "A" and "B", thus providing for the orthogonal magnetic and electric field components described previously. The "hoop" type magnet 110 may be secured to the casing 42 by any convenient manner, an epoxy glue 118 being shown as an illustrative example.

Figure 5:
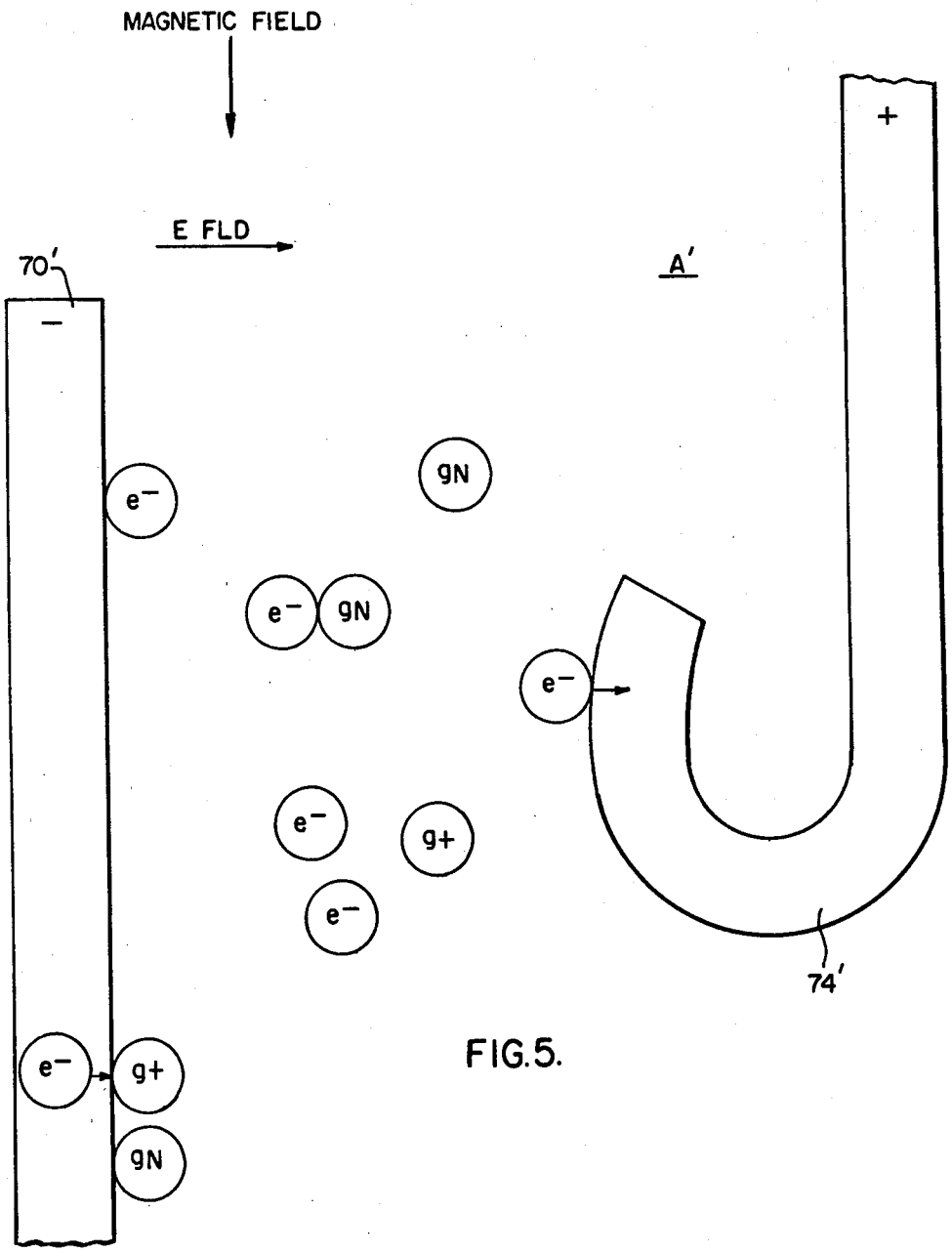
FIG. 5 shows a representative drawing of the action which occurs between two shields of a circuit interrupter apparatus such as is shown in FIG. 4 or more particularly FIG. 7.
Figure 8:
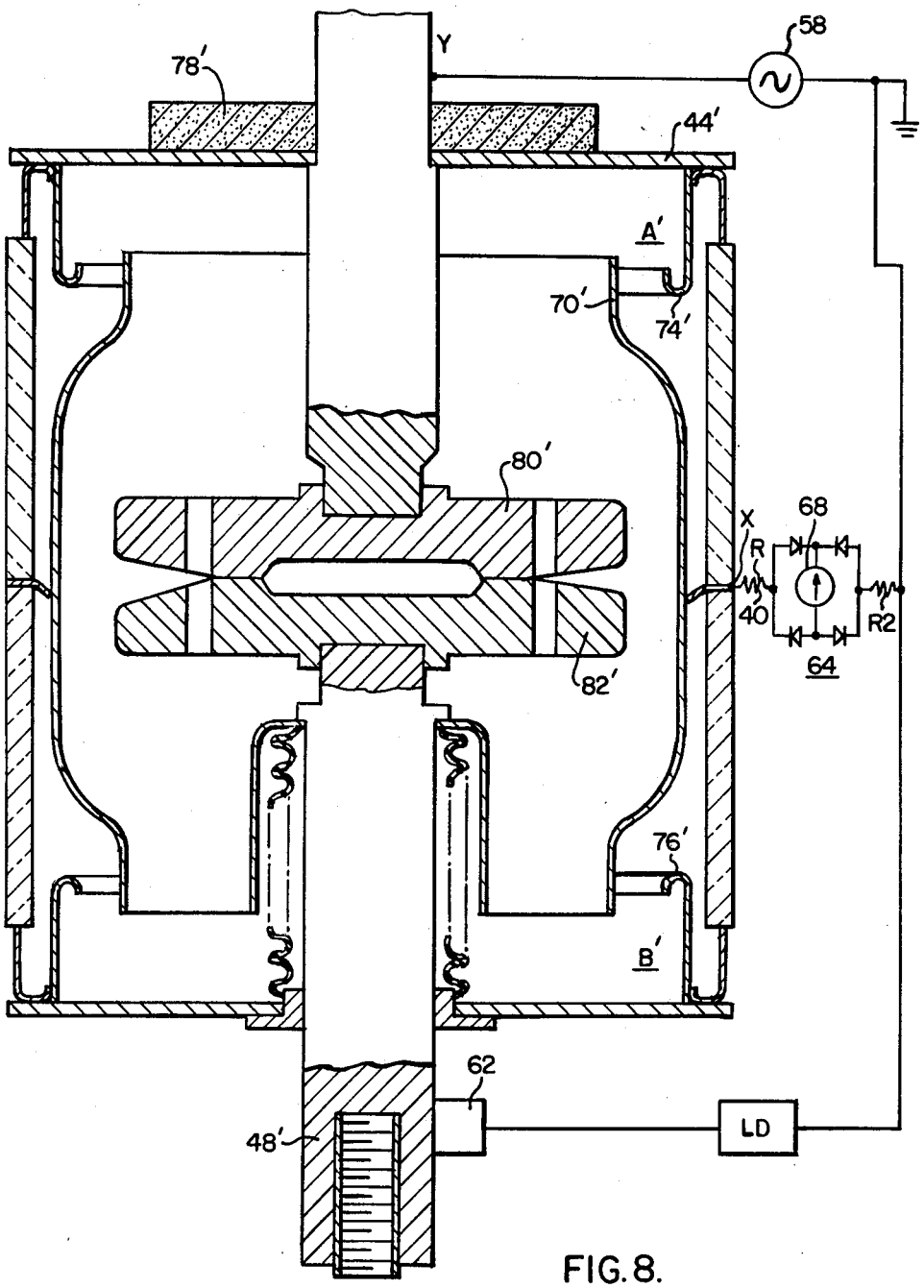
FIG. 8 shows an embodiment similar to that shown in FIG. 7 but which utilizes a magnet.

FIG. 5 shows a portion of a shield 70' and a portion of a shield 74' which may also be seen in FIG. 8. In the region A' of FIG. 8 at a time when the shield 74' is positive with respect to the shield 70', the electrostatic field set up by the high voltage source 58 may draw electrons $e^-$ away from the plate 70'. The transverse magnetic fields designated as such in FIG. 5 causes the electrons to take a path which is perpendicular to both the magnetic field and the electrostatic field. This causes the electrons to remain in the region between the two plates 70' and 74' rather than to migrate very quickly to the other plate. When this happens, the likelihood of a gas molecule gN being struck by an electron is enhanced in which case another electron may be dislodged from the once-neutral gas molecule gN thus producing two electrons and a positively charged gas molecule g+. Once an avalanche condition is reached, the relative number of electrons produced tends to approach a limiting value, e.g., $10^{+10}$ electrons per cubic centimeter. This density of electrons provides a relatively reliable ion gauge. Consequently, if the gas, such as represented by the molecules gN, is present in the region designated A' between the shields 70' and 74' for example, the electrons will strike some of the gas molecules as mentioned, thus causing other electrons to be given of, thus sustaining the electron density at approximately $10^{+10}$ electrons per cubic centimeter. Of course as was mentioned, the gas molecules acquire a positive electrical charge when impacted by the electron. The charged molecules g+ therefore migrate, in this case towards the plate 70', to combine with an electron on the surface of the plate 70' to once again neutralize its charge. Of course, some of the electrons in the region between the plates 70' and 74' migrate to the plate 74'. The net effect of the latter two actions is to produce a net current which is a reliable indication of the number of gas molecules present in the region A'. One can see that the accurate detection of this current has the effect of indicating the relative vacuum quality of the region A'. Since the region A' is contiguous with the entire region within the circuit interrupter 32 or 32' as the case may be, a reliable indication of the quality of the vacuum in the region of the electrodes 80 and 82 or 80' and 82' as the case may be, is given. As has been mentioned before, this is very desirable.

Figure 6:
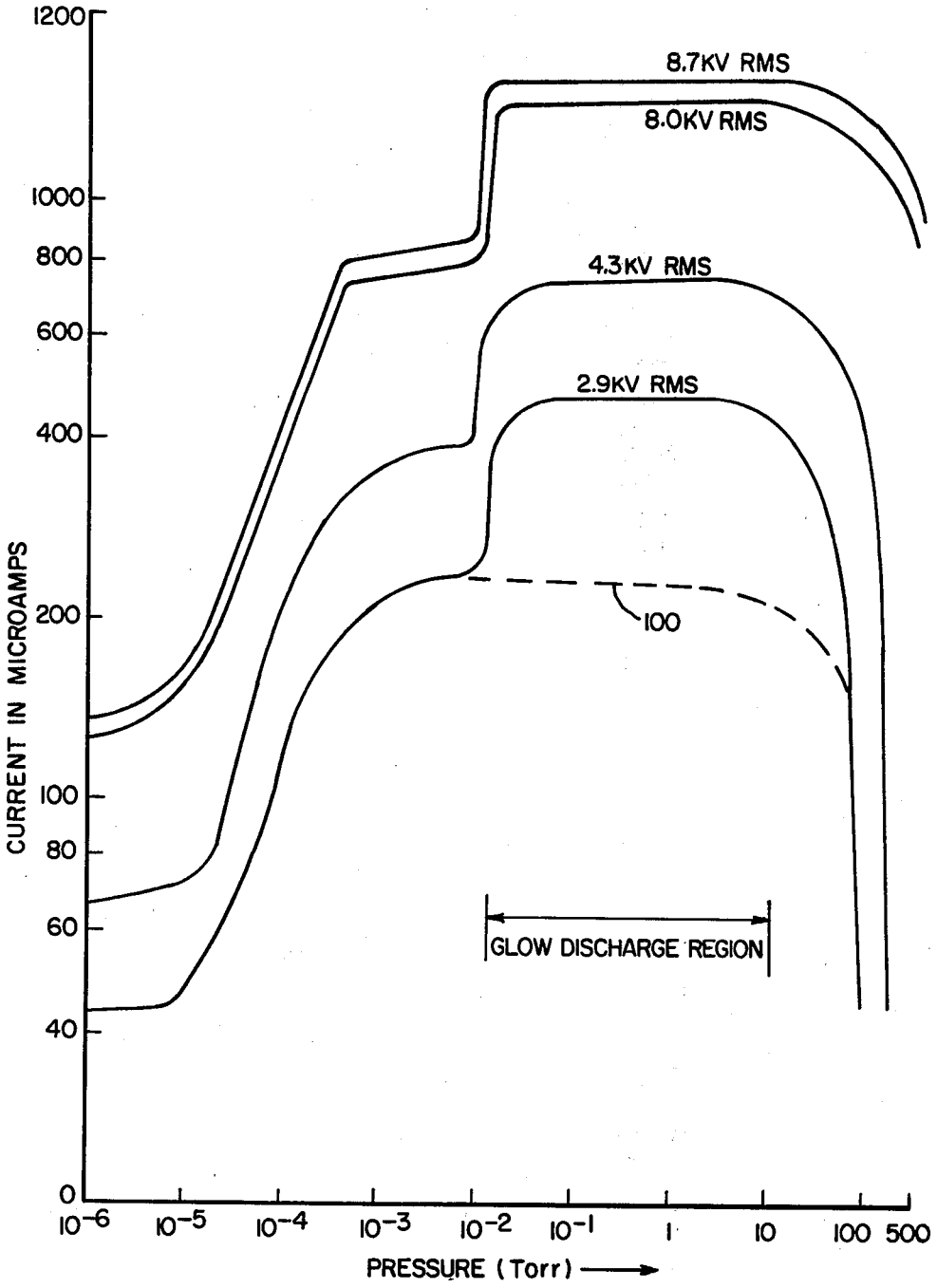
FIG. 6 shows a plot of pressure versus current for the apparatus of FIG. 4 for example.
Figure 7:
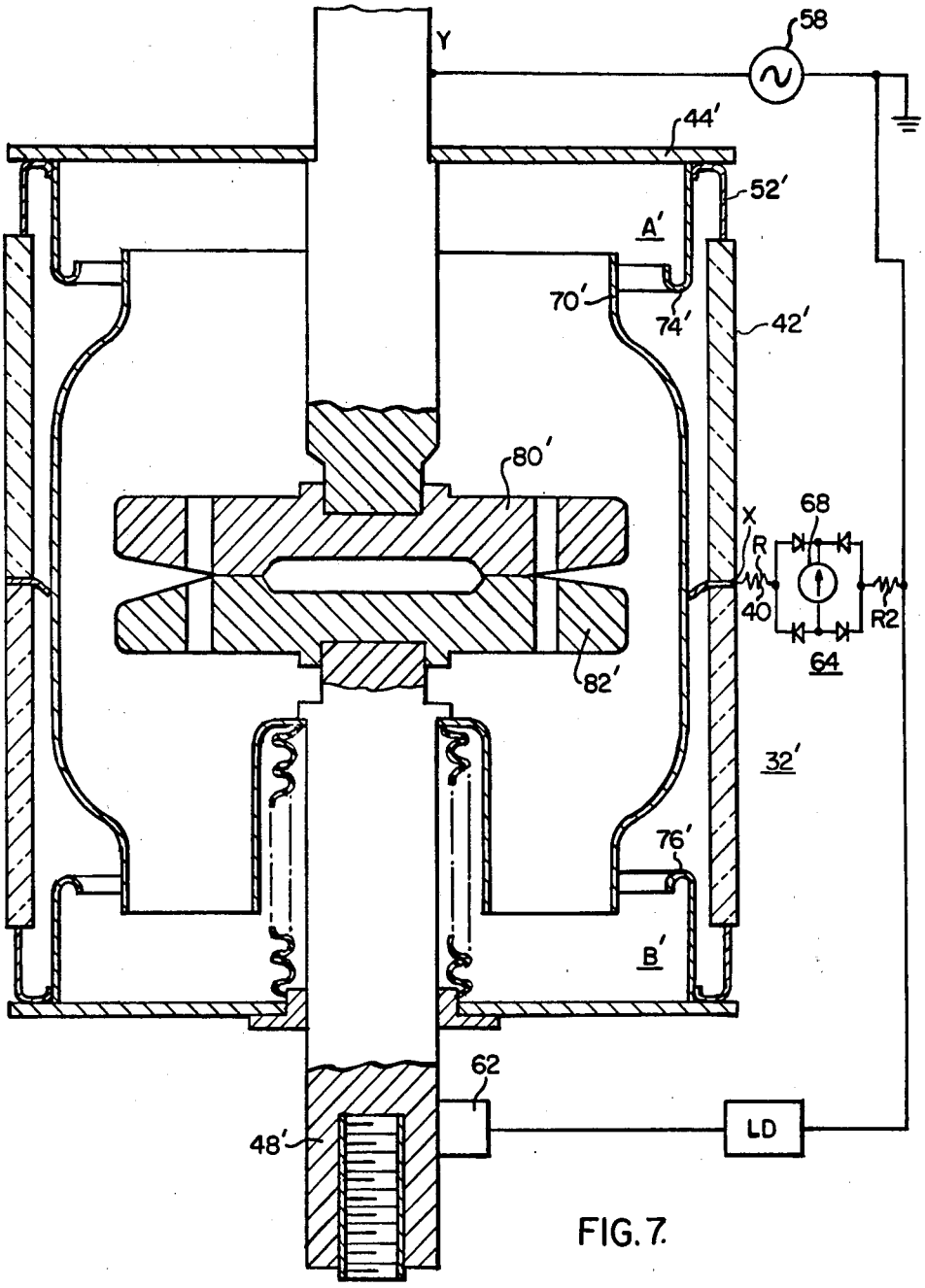
FIG. 7 shows an embodiment similar to that shown in FIG. 4 but with a slightly different shield configuration and with no magnet.

Referring now to FIG. 6, plots of microampere current produced in a region such as A', or a combination of regions such as A' and B' as shown in FIG. 7, versus pressure in torque is given for four different values of a voltage or a.c. source such as 58. In particular, the voltage values are 2.9 kilovolts RMS, 4.3 kilovolts RMS, 8 kilovolts RMS, and 8.7 kilovolts RMS. In the region to the far left of FIG. 7, that is in the region represented by pressure $10^{-6}$ Torr, the amount of gas molecules available for interacting in the ion gauge region such as A' of FIG. 5 is so small that the current, I, is essentially represented by the value $I=CdV/dt$, where C is the capacitance between the shields and V is the voltage appearing across the shield. This current is the current measured, for example, in the microammeter 68 of the current detection device 64 of FIG. 7. As the pressure increases, it can be seen that the current rises in relation thereto. Generally, in this region of the graph of FIG. 6, only half-wave conduction takes place in the detection device 64. However, as the pressure increases to a value of approximately $10^{-2}$ Torr, the amount of gas present is so large that glow discharge takes place between the shields 70 and 74, for example, so that current flows in both directions through the bridge rectifier 64. This is represented by the significant hump in the curves at approximately $10^{-2}$ Torr. It is to be noted that the relatively linear region between $10^{-5}$ Torr and $10^{-3}$ Torr is the most useful region for determining the amount of vacuum as a direct function of the current flowing in the ammeter 68. The linear relationship of the curve is the reason for this. However, in this region and up until glow discharge is reached, the ion detector device which might be called a "magnetron" or "Penning" device, tends to act like a half-wave rectifier, that is it passes current in only one direction. When glow discharge takes place, current passes in both directions which is the reason for the sudden increase in total current. If the detection device is a full-wave bridge rectifier such as is shown at 64, then the increase in the current will be readily seen. However, if the detection device is a half-wave bridge rectifier the curve for 2.9 kilovolts RMS for example will follow a shape more like that shown at 100, which is depicted more accurately in FIG. 9. One of the advantages of utilizing the shields 70 and 74 for example, or 70 and 76, in determining pressure is the wide range of detection capability, i.e. from approximately $10^{-6}$ Torr to nearly to atmosphere. Of course in the region past $10^{-3}$ Torr, the linear relationship changes so that an accurate determination of the amount of vacuum can no longer be determined by reading the current. However, it should be noted that in this latter plateau region, quantitative knowledge about the vacuum is unnecessary since the pressure is so high that the vacuum interrupted should not be operated. It is also to be noted that in this latter region the amount of gas molecules present are so large that a magnet such as 78 shown in FIG. 4, is not necessary to sustain the electrons in the inner electrode region, i.e. between the shields 70 and 74 for example, for a period of time necessary to cause interreaction with neutral gas molecules. As a result of this, the vacuum detection device may be utilized reliably as a loss of vacuum detector without the utilization of the magnet in the pressure region above $10^{-3}$ Torr. It is well known that a vacuum pressure of $10^{-3}$ Torr or above is undesirable for interrupting electrical current and is considered by most in the art as a region in which the integrity of the vacuum interrupter has completely broken down so that the interrupter is no longer reliable for utilization. In the region above 10 or 100 Torr, the pressure becomes so high that the glow discharge is not maintainable with typically applied voltage 58. Consequently, the current detected in this region is approximately equal to the current detected in the $10^{-6}$ Torr region.

Figure 9:
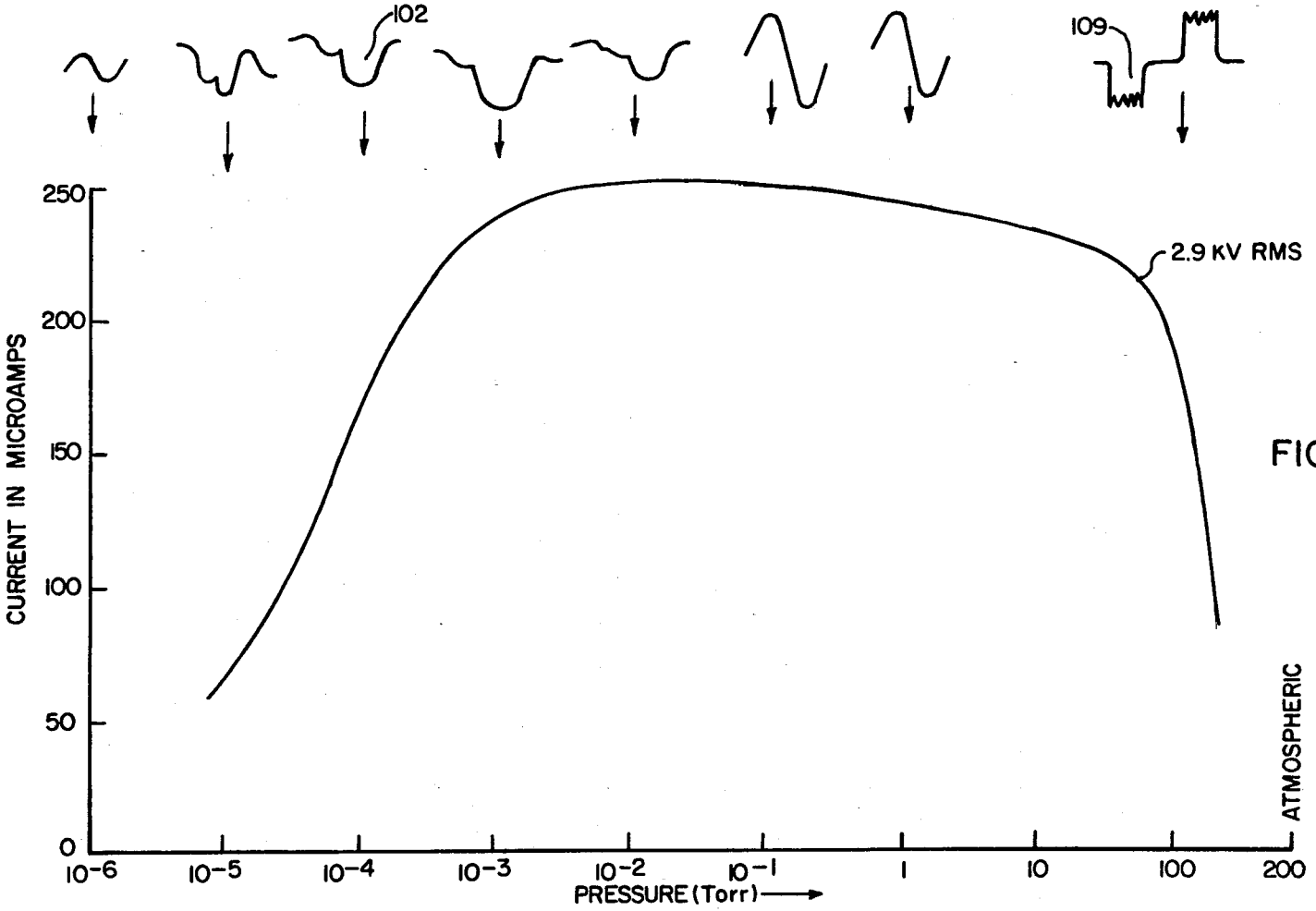
FIG. 9 shows a plot of pressure versus current for a portion of the plot shown in FIG. 6.

Referring now to FIG. 9, a plot of the 2.9 KV RMS curve of FIG. 6 is shown in detail in the $10^{-5}$ Torr to $10^{+2}$ Torr region. The aforementioned curve was produced using only a half-wave bridge rectifier but was also taken utilizing an oscilloscope across a resistive element such as R2 shown in FIG. 4. The significance is that the wave shapes produced may be detected for various values of pressure current. In the curve of FIG. 9, one value of current may be indicative of two different pressures, for example at approximately $10^{-4}$ Torr and approximately 100 Torr, a current of 180 microamps is detected. One person reading 180 microamperes on the ammeter would not know whether the pressure inside the circuit interrupter was an acceptable $10^{-4}$ Torr or an undesirable 100 Torr. However, by comparing wave shapes such as is shown at 102 and 109 on the curve of FIG. 9, for example, the difference is such that it can easily be determined in which portion of the curve one is observing current, which may mean the difference between allowing a circuit interrupter to open in a perfectly acceptable vacuum or in a very undesirable high pressure region.

Referring now to FIG. 7, still another embodiment of the invention is shown in which a vacuum circuit interrupter and an associated external voltage source detector system and load are also depicted. In the embodiment of FIG. 7, the magnet of the embodiment of FIG. 4 is purposely deleted. Furthermore, the shield arrangement represented at 70', 74' and 76' is different from that shown at 70, 74 and 76 in FIG. 4. To be more specific, the shield 70' axially overlaps shields 74' and 76' in the embodiment of FIG. 7 whereas that is not the case in the embodiment of FIG. 4. Consequently, the annular regions A' and B' are slightly different in volume and shape in the embodiment of FIG. 7 than the annular regions A and B in the embodiment of FIG. 4. Otherwise, the operation is essentially the same except for the fact that the embodiment of FIG. 7 is of the type which is used primarily in the region depicted in FIG. 6 between $10^{-2}$ Torr and 100 Torr. That is to say, in the embodiment of FIG. 7 the detecting device 64 is utilized to detect whether there has been a failure of vacuum or not.

Referring now to FIG. 8, still a further embodiment of the invention is shown which utilizes principles from the embodiments of the invention shown in FIGS. 4 and 7. To be more specific, the embodiment of FIG. 8 shows the axially overlapping shields 70', 74' and 76' which were previously shown in the embodiment of FIG. 7 and furthermore shows the magnet 78' which was previously shown in the embodiment of FIG. 4. With regard the embodiments of FIG. 7 and FIG. 8, it will be noted that the end plate 44' is not depressed as the end plate 44 is in FIG. 4. However, it is to be recognized that this is a matter of design choice in this particular embodiment of the invention and that neither the depressed end plate 44 nor the non-depressed end plate 44' is limiting.

Figure 10:
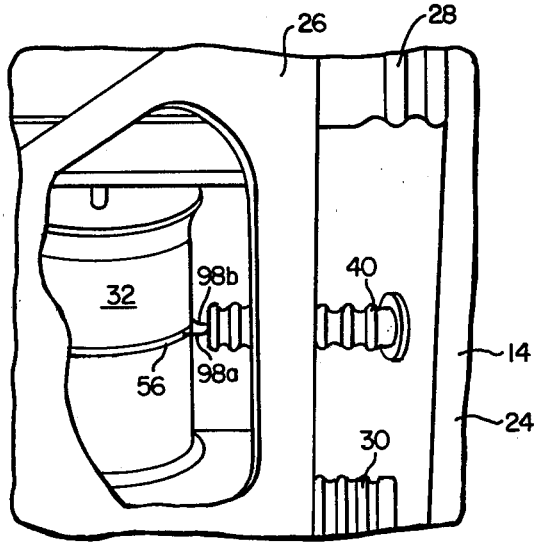
FIG. 10 shows a side orthogonal elevation partially broken away of the vacuum circuit interrupter bottles as utilized in the apparatus of FIGS. 1 and 2.
Figure 11:
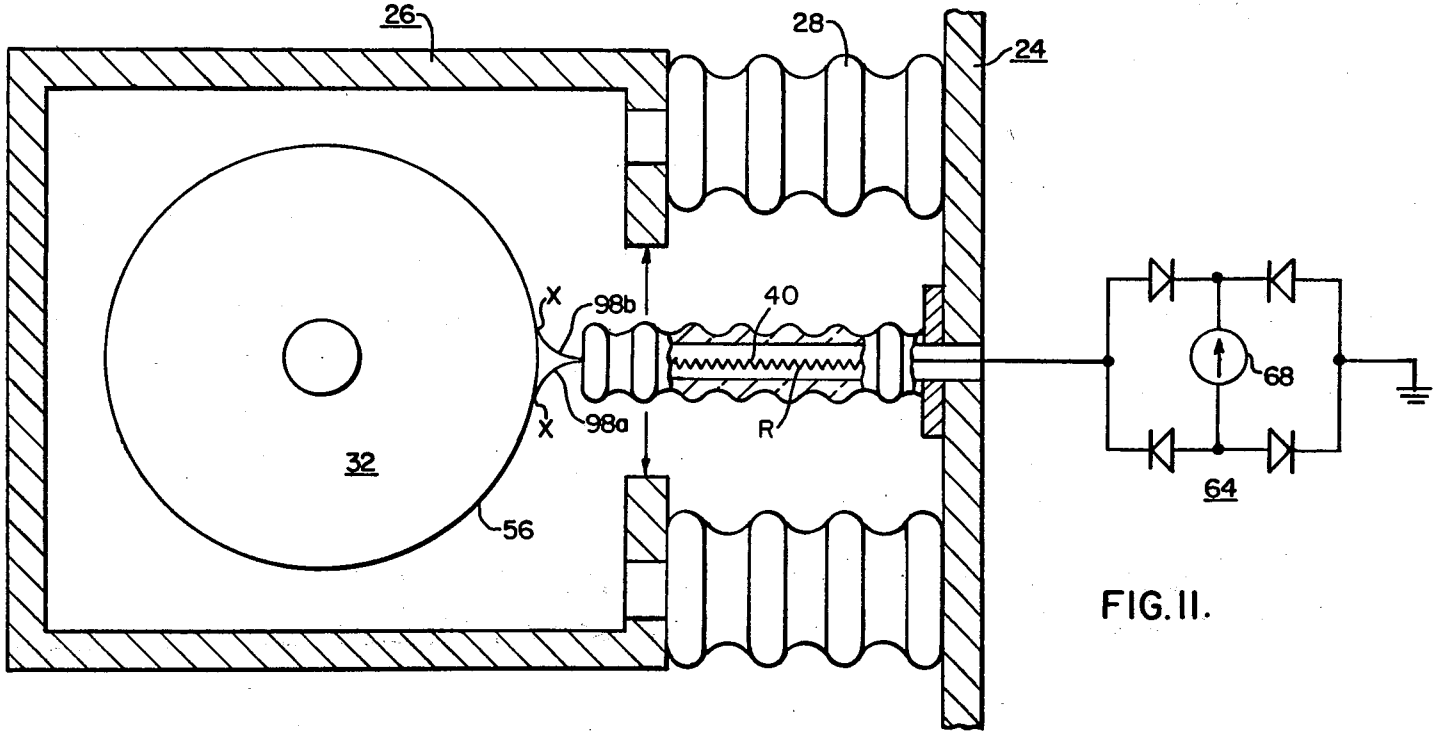
FIG. 11 shows a partial cross-sectional view partially in schematic form of the apparatus of FIG. 10.
Figure 12:
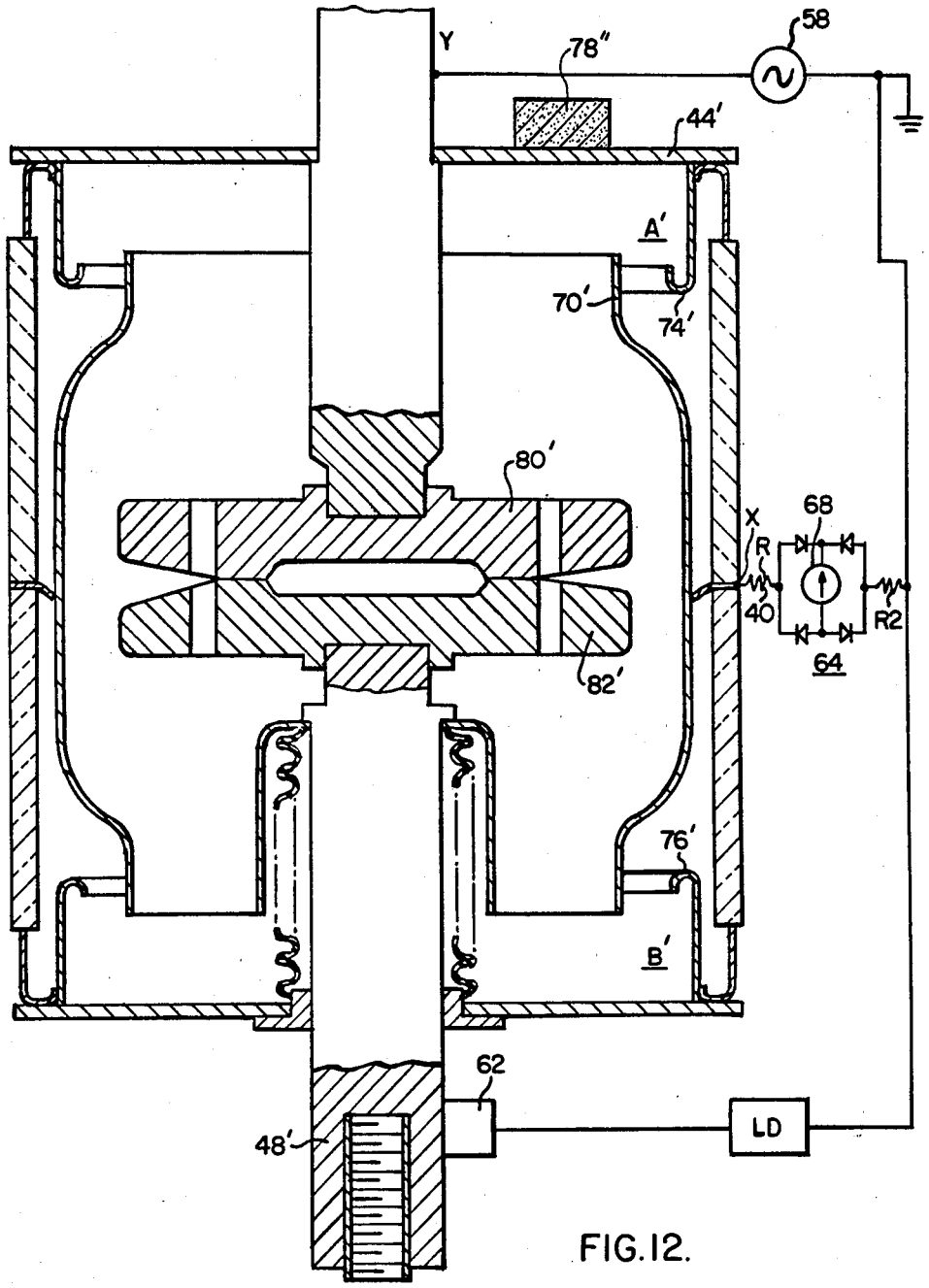
FIG. 12 shows still another embodiment of the invention similar to those shown in FIGS. 7 and 8 but in which the magnet is radially offset from the centerline of the circuit interrupter.

Referring now to FIGS. 10 and 11, that portion of the circuit interrupter apparatus shown in FIG. 2 for example, is depicted herein in greater magnification. As is best shown in FIG. 11, the resistive element R or 40 as is shown in FIG. 4 for example, is disposed within a porcelain or other good insulator cylindrical casing to provide high voltage insulation along the outer surface thereof between the high voltage section and the low voltage section 24. It will be recalled that the high voltage section 26 includes the vacuum interrupter 32 whereas the low voltage section 24 includes the detector 64. As is best shown in FIG. 11, fork-like electrically conducting tynes protrude out of one end of the insulated resistive element 40 to make forceful tangential electrical contact at the points X—X with the shield ring 56 to complete the necessary electrically conducting path between the detector 64 and the circuit interrupter 32. The tynes are identified as 98*a* and 98*b*. In the assembly process the tynes 98*a* and 98*b* flex as the resistive element R is brought into contact with the ring 56 to increase the contact pressure and thus reduce the contact resistance. Referring now to FIG. 12, another embodiment of the invention is shown in which a magnet 78″ is radially offset from the stem so that the produced magnetic field may be non-symmetrical. This means that the magnet 78″ need not enclose or encircle the stem. This leads to simpler construction of the circuit interrupter.

Figure 13:
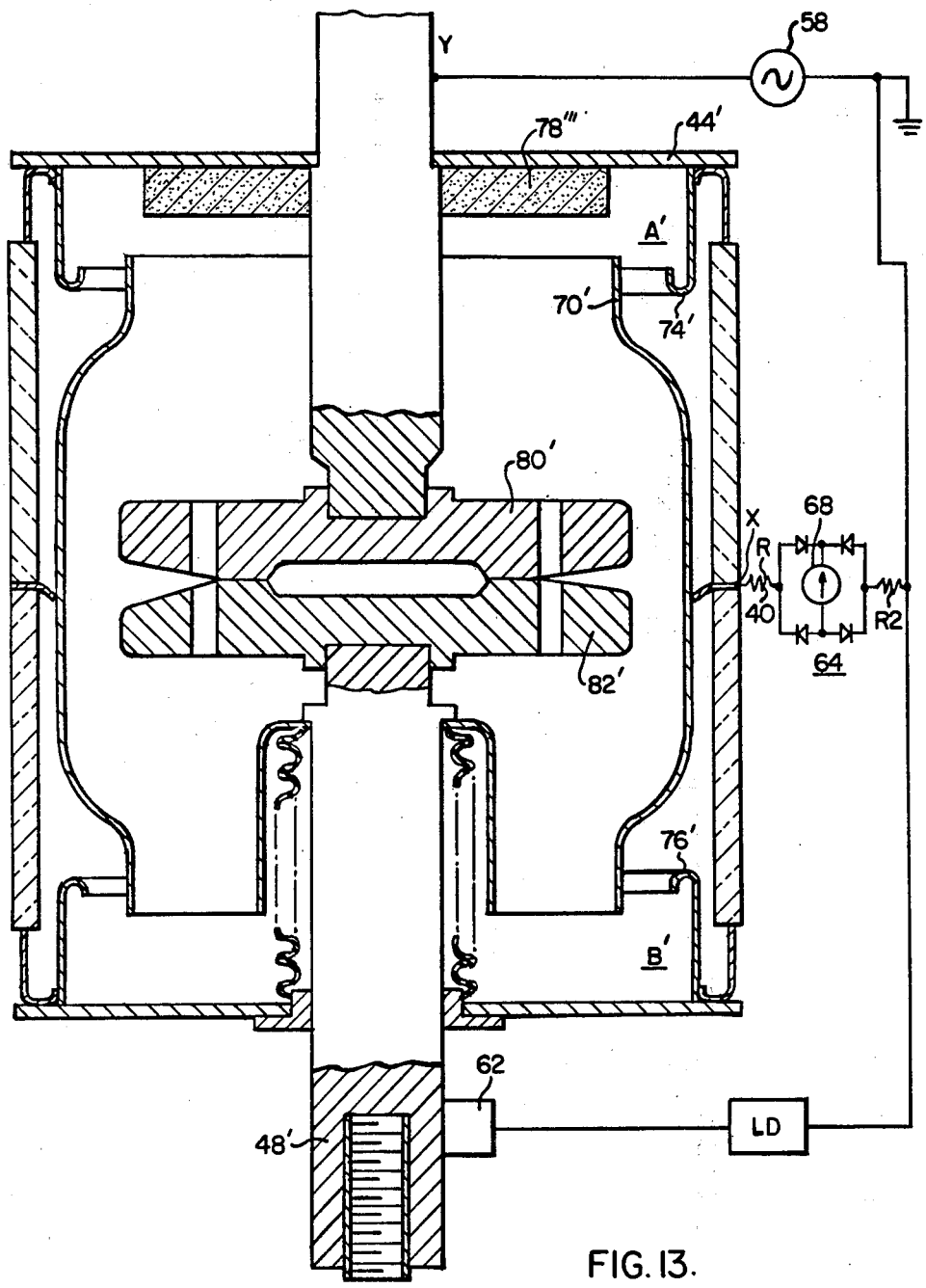
FIG. 13 shows an embodiment similar to that of FIG. 12 in which the magnet is disposed inside of the circuit interrupter enclosure.

In still another embodiment of the invention as shown in FIG. 13, a magnet 78‴ is placed inside of the circuit interrupter.

It is to be understood with respect to the embodiments of this invention that the particular kind of vacuum circuit interrupter utilized is non-limiting provided there are at least one set of shields in a path of electrical conduction and where one of the shields makes an interconnection (not necessarily ohmic) with a voltage detection network for circuit completion with the high voltage source which is interconnected with the other shield. It is also to be understood that the bridge circuit 64 may be replaced by any suitable measuring circuit. It is also to be understood that the invention is not limited to use in three-phase electrical operation. It may be useful in single-phase electrical operation or other polyphase electrical operation or even DC electrical operation. The principles taught herein may be used with other types of vacuum devices such as triggered gaps, switches and the like. It is also to be understood that when magnets are used the invention is not limited to use with "pancake" shaped magnets such as is shown in FIG. 4. In addition, non-axially symmetric magnets have been demonstrated to be equally useful in certain vacuum interrupters.

The apparatus taught with respect to the embodiments of this invention has many advantages. One advantage lies in the fact that the "Magnetron" or "Penning" type ion detection gauge is operable over an extremely wide range of pressures for providing useful data concerning the status of vacuum within a circuit interrupter or similar device. Another advantage lies in the fact that the utilization of the end shields of a vacuum circuit interrupter helps to maintain high voltage isolating characteristics. Furthermore, the present invention does not require the addition of further leak regions than are already present in the vacuum interrupter for vacuum detection and also the present invention utilizes existing vacuum interrupter geometry for reduced costs. Other advantages lie in the fact that the present device utilizes a.c. power, requires no further power than is available to the interrupter (i.e., no separate power supply), and is extremely sensitive over a wide pressure range.

What we claim as our invention is:

1. A vacuum circuit interrupter, comprising:

(a) a circuit interrupter frame;

(b) enclosure means defining a substantially evacuated volume disposed upon said frame;

(c) external voltage source means;

(d) relatively movable contact means electrically interconnected with said voltage source means and disposed to interrupt electrical current within said evacuated volume;

(e) first and second spaced electrically conductive vapor deposition shield means disposed within said enclosure means for protecting internal portions of said enclosure means from metal vapor products associated with the interruption of said electrical current within said evacuated volume, said first and second spaced electrically conductive vapor deposition shield means forming therebetween an annular subvolume, said first of said shield means being electrically interconnected with one potential of said external voltage source means, said second of said shield means communicating electrically with an electrical conductor on the outer portion of said enclosure means;

(f) a voltage dropping encapsulated resistor means insulatingly disposed upon said frame, said resistor means having a contact portion, said contact portion making electrical contact with said electrical conductor on the outer portion of said enclosure means; and (g) generally lower voltage relative to said shield means current measurement means disposed outside of said enclosure means in circuit relationship with the other end of said resistor means and a lower potential of said voltage source means so that an electric field of sufficient magnitude is present in said annular subvolume to cause electrons to move from the region of one of said first or said second shield means, said electrons interacting with gas molecules in said subvolume to form gas ions which in turn interact with one of said shield means to thus cause electrical current to flow through said current measurement means to thus give an indication of the amount of gas present in said substantially evacuated volume.

2. A vacuum circuit interrupter, comprising:

(a) a circuit interrupter frame;

(b) enclosure means defining a substantially evacuated volume disposed upon said frame;

(c) external voltage source means;

(d) relatively movable contact means electrically interconnected with said voltage source means and disposed to interrupt electrical current within said evacuated volume;

(e) first and second spaced electrically conductive vapor deposition shield means disposed within said enclosure means for protecting internal portions of said enclosure means from metal vapor products associated with the interruption of said electrical current within said evacuated volume, said first and second spaced electrically conductive vapor deposition shield means forming therebetween an annular subvolume, said first of said shield means being electrically interconnected with one potential of said external voltage source means, said second of said shield means communicating electrically with an electrical conductor on the outer portion of said enclosure means;

(f) magnetic field producing means disposed proximate to said enclosure means for providing a magnetic field in said annular subvolume;

(g) a voltage dropping encapsulated resistor means insulatingly disposed upon said frame, said resistor means having a contact portion, said contact portion making electrical contact with said electrical conductor on the outer portion of said enclosure means; and (h) generally lower voltage relative to said shield means current measurement means disposed outside of said enclosure means in circuit relationship with the other end of said resistor means and with a lower potential of said voltage source means so that an electric field of sufficient magnitude is present in said annular subvolume to cause electrons to move from the region of one of said first or said second shield means, said magnetic field being oriented relative to said electric field so as to cause said electrons to move in a path in said annular subvolume which will cause said electrons to generally remain in said annular subvolume for a longer period of time than if said magnetic field were not present, said electrons thus interacting with gas molecules in said subvolume at a sufficient rate so as to form a sufficient number of gas ions to interact with one of said shield means to thus cause electrical current to flow through said current measurement means to thus give a reliable indication of the amount of gas present in said substantially evacuated volume.

3. A vacuum circuit interrupter, comprising:

(a) a circuit interrupter frame;

(b) enclosure means defining a substantially evacuated volume disposed upon said frame;

(c) external voltage source means;

(d) relatively movable contact means electrically interconnected with said voltage source means and disposed to interrupt electrical current within said evacuated volume;

(e) first and second spaced electrically conductive shield means disposed within said enclosure means for protecting internal portions of said enclosure means, said first and second shield means having therebetween a subvolume, said first of said shield means being electrically interconnected with said external voltage source means for having a voltage potential existent thereon, said second of said shield means communicating electrically with an electrical conductor on the outer portion of said enclosure menas;

(f) a voltage dropping encapsulated resistor means insulatingly disposed upon said frame, said resistor means having a contact portion, said contact portion making electrical contact with said electrical conductor on the outer portion of said enclosure means; and (g) generally lower voltage relative to said shield means current measurement means disposed outside of said enclosure means in circuit relationship with the other end of said resistor means and said voltage source means at a lower electrical potential so that an electric field of sufficient magnitude is present in said subvolume to cause electrons which are present in said subvolume to interact with gas molecules in said subvolume to form gas ions which in turn interact with one of said shield means to thus cause ionic electrical current to flow through said current measurement means to thus give an indication of the amount of gas present in said substantially evacuated volume.

4. A vacuum circuit interrupter, comprising:

(a) a circuit interrupter frame;

(b) enclosure means defining a substantially evacuated volume disposed upon said frame;

(c) external voltage source means;

(d) relatively movable contact means electrically interconnected with said voltage source means and disposed to interrupt electrical current within said evacuated volume;

(e) first and second spaced electrically conductive shield means disposed within said enclosure means for protecting internal portions of said enclosure means, said first and second shield means having therebetween a subvolume, said first of said shield means being electrically interconnected with said external voltage source means for having a voltage potential existent thereon, said second of said shield means communicating electrically with an electrical conductor on the outer portion of said enclosure means;

(f) magnetic field producing means disposed proximate to said enclosure means for providing a magnetic field in said subvolume;

(g) a voltage dropping encapsulated resistor means insulatingly disposed upon said frame, said resistor means having a contact portion, said contact portion making electrical contact with said electrical conductor on the outer portion of said enclosure means; and (h) generally lower voltage relative to said shield means current measurement means disposed outside of said enclosure means in circuit relationship with the other end of said resistor means and with a lower electrical potential of said voltage source means so that an electric field is present in said subvolume, said magnetic field being oriented relative to said electric field so as to cause electrons which are present in said subvolume to move in a path in said subvolume which will cause said electrons to generally remain in said subvolume for a longer period of time than if said magnetic field were not present, said electrons thus interacting with gas molecules in said subvolume at a sufficient rate so as to form a sufficient number of gas ions to interact with one of said shield means to thus cause electrical current to flow through said current measurement means to thus give a reliable indication of the amount of gas present in said substantially evacuated volume.

5. A vacuum circuit interrupter, comprising:

(a) a circuit interrupter frame;

(b) enclosure means defining a substantially evacuated volume disposed upon said frame;

(c) relatively movable contact means electrically interconnectable with an external voltage source means and disposed to interrupt electrical current within said evacuated volume;

(d) first and second spaced electrically conductive vapor deposition shield means disposed within said enclosure means for protecting internal portions of said enclosure means from metal vapor products associated with the interruption of said electrical current within said evacuated volume, said first and second spaced electrically conductive vapor deposition shield means forming therebetween an annular subvolume, said first of said shield means being electrically interconnectable with one potential of said external voltage source means, said second of said shield means communicating electrically with an electrical conductor on the outer portion of said enclosure means;

(e) a voltage dropping encapsulated resistor means insulatingly disposed upon said frame, said resistor means having a contact portion, said contact portion making electrical contact with said electrical conductor on the outer portion of said enclosure means; and (f) generally lower voltage relative to said shield means current measurement means disposed outside of said enclosure means in circuit relationship with the other end of said resistor means and connectable with a lower potential of said voltage source means so that an electric field of sufficient magnitude is present in said annular subvolume to cause electrons to move from one of said first or said second shield means, said electrons interacting with gas molecules in said subvolume to form gas ions which in turn interact with one of said shield means to thus cause ionic electrical current to flow through said current measurement means to thus give an indication of the amount of gas present in said substantially evacuated volume.

6. A vacuum circuit interrupter, comprising:

(a) a circuit interrupter frame;

(b) enclosure means defining a substantially evacuated volume disposed upon said frame;

(c) relatively movable contact means electrically interconnectable with an external voltage source means and disposed to interrupt electrical current within said evacuated volume;

(d) first and second spaced electrically conductive vapor deposition shield means disposed within said enclosure means for protecting internal portions of said enclosure means from metal vapor products associated with the interruption of said electrical current within said evacuated volume, said first and second spaced electrically conductive vapor deposition shield means forming therebetween an annular subvolume, said first of said shield means being electrically interconnectable with one potential of said external voltage source means, said second of said shield means communicating electrically with an electrical conductor on the outer portion of said enclosure means;

(e) magnetic field producing means disposed proximate to said enclosure means for providing a magnetic field in said annular subvolume;

(f) a voltage dropping encapsulated resistor means insulatingly disposed upon said frame, said resistor means having a contact portion, said contact portion making electrical contact with said electrical conductor on the outer portion of said enclosure means; and (g) generally lower voltage relative to said shield means current measurement means disposed outside of said enclosure means in circuit relationship with the other end of said resistor means and connectable to a lower potential of said voltage source means so that an electric field of sufficient magnitude is present in said annular subvolume to cause electrons to move from the region of one of said first or said second shield means, said magnetic field being oriented relative to said electric field so as to cause said electrons to move in a path in said annular subvolume which will cause said electrons to generally remain in said annular subvolume for a longer period of time than if said magnetic field were not present, said electrons thus interacting with gas molecules in said subvolume at a sufficient rate so as to form a sufficient number of gas ions to interact with one of said shield means to thus cause electrical current to flow through said current measurement means to thus give a reliable indication of the amount of gas present in said substantially evacuated volume.

7. A vacuum circuit interrupter, comprising:

(a) a circuit interrupter frame;

(b) enclosure means defining a substantially evacuated volume disposed upon said frame;

(c) relatively movable contact means electrically interconnectable with an external voltage source means and disposed to interrupt electrical current within said evacuated volume;

(d) first and second spaced electrically conductive shield means disposed within said enclosure means for protecting internal portions of said enclosure means, said first and second shield means having therebetween a subvolume, said first of said shield means being electrically interconnectable with said external voltage source means for having a voltage potential existent thereon, said second of said shield means communicating electrically with an electrical conductor on the outer portion of said enclosure means;

(e) a voltage dropping encapsulated resistor means insulatingly disposed upon said frame, said resistor means having a contact portion, said contact portion making electrical contact with said electrical conductor on the outer portion of said enclosure means; and (f) generally lower voltage relative to said shield means current measurement means disposed outside of said enclosure means in circuit relationship with the other end of said resistor means and connectable with said voltage source means at a lower electrical potential so that an electric field of sufficient magnitude is present in said subvolume to cause electrons which are present in said subvolume to interact with gas molecules in said subvolume to form gas ions which in turn interact with one of said shield means to thus cause electrical current to flow through said current measurement means to thus give an indication of the amount of gas present in said substantially evacuated volume.

8. A vacuum circuit interrupter, comprising:

(a) a circuit interrupter frame;

(b) enclosure means defining a substantially evacuated volume disposed upon said frame;

(c) relatively movable contact means electrically interconnectable with an external voltage source means and disposed to interrupt electrical current within said evacuated volume;

(d) first and second spaced electrically conductive shield means disposed within said enclosure means for protecting internal portions of said enclosure means, said first and second shield means having therebetween a subvolume, said first of said shield means being electrically interconnectable with said external voltage source means for having a voltage potential existent thereon, said second of said shield means communicating electrically with an electrical conductor on the outer portion of said enclosure means;

(e) magnetic field producing means disposed proximate to said enclosure means for providing a magnetic field in said subvolume;

(f) a voltage dropping encapsulated resistor means insulatingly disposed upon said frame, said resistor means having a contact portion, said contact portion making electrical contact with said electrical conductor on the outer portion of said enclosure means; and (g) generally lower voltage relative to said shield means current measurement means disposed outside of said enclosure means in circuit relationship with the other end of said resistor means and connectable to a lower electrical potential of said voltage source means so that an electric field is present in said subvolume, said magnetic field being oriented relative to said electric field so as to cause electrons which are present in said subvolume to move in a path in said subvolume which will cause said electrons to generally remain in said subvolume for a longer period of time than if said magnetic field were not present, said electrons thus interacting with gas molecules in said subvolume at a sufficient rate so as to form a sufficient number of gas ions to interact with one of said shield means to thus cause electrical current to flow through said current measurement means to thus give a reliable indication of the amount of gas present in said substantially evacuated volume.

9. Switchgear apparatus, comprising:

metal cabinet means including terminal means for interconnecting an electrical circuit thereto;

vacuum circuit interrupter means disposed in said cabinet means and interconnected electrically with said terminal means for operating to protect said electrical circuit at an appropriate time, comprising:

(a) a circuit interrupter frame;

(b) enclosure means defining a substantially evacuated volume disposed upon said frame;

(c) external voltage source means;

(d) relatively movable contact means electrically interconnected with said voltage source means and disposed to interrupt electrical current within said evacuated volume;

(e) first and second spaced electrically conductive vapor deposition shield means disposed within said enclosure means for protecting internal portions of said enclosure means from metal vapor products associated with the interruption of said electrical current within said evacuated volume, said first and second spaced electrically conductive vapor deposition shield means forming therebetween an annular subvolume, said first of said shield means being electrically interconnected with one potential of said external voltage source means, said second of said shield means communicating electrically with an electrical conductor on the outer portion of said enclosure means;

(f) a voltage dropping encapsulated resistor means insulatingly disposed upon said frame, said resistor means having a contact portion, said contact portion making electrical contact with said electrical conductor on the outer portion of said enclosure means; and (g) generally lower voltage relative to said shield means current measurement means disposed outside of said enclosure means in circuit relationship with the other end of said resistor means and potential of said voltage source means so that an electric field of sufficient magnitude is present in said annular subvolume to cause electrons to move from the region of one of said first or said second shield means, said electrons interacting with gas molecules in said subvolume to form gas ions which in turn interact with one of said shield means to thus cause electrical current to flow through said current measurement means to thus give an indication of the amount of gas present in said substantially evacuated volume.

10. Switchgear apparatus, comprising:

metal cabinet means including terminal means for interconnecting an electrical circuit thereto;

vacuum circuit interrupter means disposed in said cabinet means and interconnected electrically with said terminal means for operating to protect said electrical circuit at an appropriate time, comprising:

(a) a circuit interrupter frame;

(b) enclosure means defining a substantially evacuated volume disposed upon said frame;

(c) external voltage source means;

(d) relatively movable contact means electrically interconnected with said voltage source means and disposed to interrupt electrical current within said evacuated volume;

(e) first and second spaced electrically conductive vapor deposition shield means disposed within said enclosure means for protecting internal portions of said enclosure means from metal vapor products associated with the interruption of said electrical current within said evacuated volume, said first and second spaced electrically conductive vapor deposition shield means forming therebetween an annular subvolume, said first of said shield means being electrically interconnected with one potential of said external voltage source means, said second of said shield means communicating electrically with an electrical conductor on the outer portion of said enclosure means;

(f) magnetic field producing means disposed proximate to said enclosure means for providing a magnetic field in said annular subvolume;

(g) a voltage dropping encapsulated resistor means insulatingly disposed upon said frame, said resistor means having a contact portion, said contact portion making electrical contact with said electrical conductor on the outer portion of said enclosure means; and (h) generally lower voltage relative to said shield means current measurement means disposed outside of said enclosure means in circuit relationship with the other end of said resistor means and with a lower potential of said voltage source means so that an electric field of sufficient magnitude is present in said annular subvolume to cause electrons to move from the region of one of said first or said second shield means, said magnetic field being oriented relative to said electric field so as to cause said electrons to move in a path in said annular subvolume which will cause said electrons to generally remain in said annular subvolume for a longer period of time than if said magnetic field were not present, said electrons thus interacting with gas molecules in said subvolume at a sufficient rate so as to form a sufficient number of gas ions to interact with one of said shield means to thus cause electrical current to flow through said current measurement means to thus give a reliable indication of the amount of gas present in said substantially evacuated volume.

11. Switchgear apparatus, comprising:

metal cabinet means including terminal means for interconnecting an electrical circuit thereto;

vacuum circuit interrupter means disposed in said cabinet means and interconnected electrically with said terminal means for operating to protect said electrical circuit at an appropriate time, comprising:

(a) a circuit interrupter frame;

(b) enclosure means defining a substantially evacuated volume disposed upon said frame;

(c) external voltage source means;

(d) relatively movable contact means electrically interconnected with said voltage source means and disposed to interrupt electrical current within said evacuated volume;

(e) first and second spaced electrically conductive shield means disposed within said enclosure means for protecting internal portions of said enclosure means, said first and second shield means having therebetween a subvolume, said first of said shield means being electrically interconnected with said external voltage source means for having a voltage potential existent thereon, said second of said shield means communicating electrically with an electrical conductor on the outer portion of said enclosure means;

(f) a voltage dropping encapsulated resistor means insulatingly disposed upon said frame, said resistor means having a contact portion, said contact portion making electrical contact with said electrical conductor on the outer portion of said enclosure means; and (g) generally lower voltage relative to said shield means current measurement means disposed outside of said enclosure means in circuit relationship with the other end of said resistor means and said voltage source means at a lower electrical potential so that an electric field of sufficient magnitude is present in said subvolume to cause electrons which are present in said subvolume to interact with gas molecules in said subvolume to form gas ions which in turn interact with one of said shield means to thus cause electrical current to flow through said current measurement means to thus give an indication of the amount of gas present in said substantially evacuated volume.

12. Switchgear apparatus, comprising:

metal cabinet means including terminal means for interconnecting an electrical circuit thereto;

vacuum circuit interrupter means disposed in said cabinet means and interconnected electrically with said terminal means for operating to protect said electrical circuit at an appropriate time, comprising:

(a) a circuit interrupter frame;

(b) enclosure means defining a substantially evacuated volume disposed upon said frame;

(c) external voltage source means;

(d) relatively movable contact means electrically interconnected with said voltage source means and disposed to interrupt electrical current within said evacuated volume;

(e) first and second spaced electrically conductive shield means disposed within said enclosure means for protecting internal portions of said enclosure means, said first and second shield means having therebetween a subvolume, said first of said shield means being electrically interconnected with said external voltage source means for having a voltage potential existent thereon, said second of said shield means communicating electrically with an electrical conductor on the outer portion of said enclosure means;

(f) magnetic field producing means disposed proximate to said enclosure means for providing a magnetic field in said subvolume;

(g) a voltage dropping encapsulated resistor means insulatingly disposed upon said frame, said resistor means having a contact portion, said contact portion making electrical contact with said electrical conductor on the outer portion of said enclosure means; and (h) generally lower voltage relative to said shield means current measurement means disposed outside of said enclosure means in circuit relationship with the other end of said resistor means and with a lower electrical potential of said voltage source means so that an electric field is present in said subvolume, said magnetic field being oriented relative to said electric field so as to cause electrons which are present in said subvolume to move in a path in said subvolume which will cause said electrons to generally remain in said subvolume for a longer period of time than if said magnetic field were not present, said electrons thus interacting with gas molecules in said subvolume at a sufficient rate so as to form a sufficient number of gas ions to interact with one of said shield means to thus cause electrical current to flow through saiid current measurement means to thus give a reliable indication of the amount of gas present in said substantially evacuated volume.

13. Switchgear apparatus, comprising:

metal cabinet means including terminal means for interconnecting an electrical circuit thereto;

vacuum circuit interrupter means disposed in said cabinet means and interconnected electrically with said terminal means for operating to protect said electrical circuit at an appropriate time, comprising:

(a) a circuit interrupter frame;

(b) enclosure means defining a substantially evacuated volume disposed upon said frame;

(c) relatively movable contact means electrically interconnectable with an external voltage source means and disposed to interrupt electrical current within said evacuated volume;

(d) first and second spaced electrically conductive vapor deposition shield means disposed within said enclosure means for protecting internal portions of said enclosure means from metal vapor products associated with the interruption of said electrical current within said evacuated volume, said first and second spaced electrically conductive vapor deposition shield means forming therebetween an annular subvolume, said first of said shield means being electrically interconnectable with one potential of said external voltage source means, said second of said shield means communicating electrically with an electrical conductor on the outer portion of said enclosure means;

(e) a voltage dropping encapsulated resistor means insulatingly disposed upon said frame, said resistor means having a contact portion, said contact portion making electrical contact with said electrical conductor on the outer portion of said enclosure means; and (f) generally lower voltage relative to said shield means current measurement means disposed outside of said enclosure means in circuit relationship with the other end of said resistor means and connectable with a lower potential of said voltage source means so that an electric field of sufficient magnitude is present in said annular subvolume to cause electrons to move from the region of one of said first or said second shield means, said electrons interacting with gas molecules in said subvolume to form gas ions which in turn interact with one of said shield means to thus cause electrical current to flow through said current measurement means to thus give an indication of the amount of gas present in said substantially evacuated volume.

14. Switchgear apparatus, comprising:

metal cabinet means including terminal means for interconnecting an electrical circuit thereto;

vacuum circuit interrupter means disposed in said cabinet means and interconnected electrically with said terminal means for operating to protect said electrical circuit at an appropriate time, comprising:

(a) a circuit interrupter frame;

(b) enclosure means defining a substantially evacuated volume disposed upon said frame;

(c) relatively movable contact means electrically interconnectable with an external voltage source means and disposed to interrupt electrical current within said evacuated volume;

(d) first and second spaced electrically conductive vapor deposition shield means disposed within said enclosure means for protecting internal portions of said enclosure means from metal vapor products associated with the interruption of said electrical current within said evacuated volume, said first and second spaced electrically conductive vapor deposition shield means forming therebetween an annular subvolume, said first of said shield means being electrically interconnectable with one potential of said external voltage source means, said second of said shield means communicating electrically with an electrical conductor on the outer portion of said enclosure means;

(e) magnetic field producing means disposed proximate to said enclosure means for providing a magnetic field in said annular subvolume;

(f) a voltage dropping encapsulated resistor means insulatingly disposed upon said frame, said resistor means having a contact portion, said contact portion making electrical contact with said electrical conductor on the outer portion of said enclosure means; and (g) generally lower voltage relative to said shield means current measurement means disposed outside of said enclosure means in circuit relationship with the other end of said resistor means and connectable to a lower potential of said voltage source means so that an electric field of sufficient magnitude is present in said annular subvolume to cause electrons to move from the region of one of said first or said second shield means, said magnetic field being oriented relative to said electric field so as to cause said electrons to move in a path in said annular subvolume which will cause said electrons to generally remain in said annular subvolume for a longer period of time than if said magnetic field were not present, said electrons thus interacting with gas molecules in said subvolume at a sufficient rate so as to form a sufficient number of gas ions to interact with one of said shield means to thus cause electrical current to flow through said current measurement means to thus give a reliable indication of the amount of gas present in said substantially evacuated volume.

15. Switchgear apparatus, comprising:

metal cabinet means including terminal means for interconnecting an electrical circuit thereto;

vacuum circuit interrupter means disposed in said cabinet means and interconnected electrically with said terminal means for operating to protect said electrical circuit at an appropriate time, comprising:

(a) a circuit interrupter frame;

(b) enclosure means defining a substantially evacuated volume disposed upon said frame;

(c) relatively movable contact means electrically interconnectable with an external voltage source means and disposed to interrupt electrical current within said evacuated volume;

(d) first and second spaced electrically conductive shield means disposed within said enclosure means for protecting internal portions of said enclosure means, said first and second shield means having therebetween a subvolume, said first of said shield means being electrically interconnectable with said external voltage source means for having a voltage potential existent thereon, said second of said shield means communicating electrically with an electrical conductor on the outer portion of said enclosure means;

(e) a voltage dropping encapsulated resistor means insulatingly disposed upon said frame, said resistor means having a contact portion, said contact portion making electrical contact with said electrical conductor on the outer portion of said enclosure means; and (f) generally lower voltage relative to said shield means current measurement means disposed outside of said enclosure means in circuit relationship with the other end of said resistor means and connectable with said voltage source means at a lower electrical potential so that an electric field of sufficient magnitude is present in said subvolume to cause electrons which are present in said subvolume to to interact with gas molecules in said subvolume to form gas ions which in turn interact with one of said shield means to thus cause electrical current to flow through said current measurement means to thus give an indication of the amount of gas present in said substantially evacuated volume.

16. Switchgear apparatus, comprising:

metal cabinet means including terminal means for interconnecting an electrical circuit thereto;

vacuum circuit interrupter means disposed in said cabinet means and interconnected electrically with said terminal means for operating to protect said electrical circuit at an appropriate time, comprising:

(a) a circuit interrupter frame;

(b) enclosure means defining a substantially evacuated volume disposed upon said frame;

(c) relatively movable contact means electrically interconnectable with an external voltage source means and disposed to interrupt electrical current within said evacuated volume;

(d) first and second spaced electrically conductive shield means disposed within said enclosure means for protecting internal portions of said enclosure means, said first and second shield means having therebetween a subvolume, said first of said shield means being electrically interconnectable with said external voltage source means for having a voltage potential existent thereon, said second of said shield means communicating electrically with an electrical conductor on the outer portion of said enclosure means;

(e) magnetic field producing means disposed proximate to said enclosure means for providing a magnetic field in said subvolume;

(f) a voltage dropping encapsulated resistor means insulatingly disposed upon said frame, said resistor means having a contact portion, said contact portion making electrical contact with said electrical conductor on the outer portion of said enclosure means; and (g) generally lower voltage relative to said shield means current measurement means disposed outside of said enclosure means in circuit relationship with the other end of said resistor means and connectable to a lower electrical potential of said voltage source means so that an electric field is present in said subvolume, said magnetic field being oriented relative to said electric field so as to cause electrons which are present in said subvolume to move in a path in said subvolume which will cause said electrons to generally remain in said subvolume for a longer period of time than if said magnetic field were not present, said electrons thus interacting with gas molecules in said subvolume at a sufficient rate so as to form a sufficient number of gas ions to interact with one of said shield means to thus cause electrical current to flow through said current measurement means to thus give a reliable indication of the amount of gas present in said substantially evacuated volume.

* * * * *